US009424777B2

(12) United States Patent
Kong et al.

(10) Patent No.: US 9,424,777 B2
(45) Date of Patent: Aug. 23, 2016

(54) ORGANIC LIGHT-EMITTING DIODE DISPLAY

(71) Applicant: Samsung Display Co., Ltd., Yongin, Gyeonggi-Do (KR)

(72) Inventors: Ji-Hye Kong, Yongin-si (KR); Yong-Sung Park, Seoul (KR); In-Ho Choi, Seoul (KR); Young-In Hwang, Suwon-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 76 days.

(21) Appl. No.: 14/561,061

(22) Filed: Dec. 4, 2014

(65) Prior Publication Data

US 2016/0012776 A1 Jan. 14, 2016

(30) Foreign Application Priority Data

Jul. 9, 2014 (KR) ..... 10-2014-0085980

(51) Int. Cl.
*G09G 3/32* (2016.01)

(52) U.S. Cl.
CPC ..... *G09G 3/3258* (2013.01); *G09G 3/3208* (2013.01); *G09G 3/3241* (2013.01); *G09G 2300/0413* (2013.01); *G09G 2300/0426* (2013.01); *G09G 2320/0223* (2013.01); *G09G 2320/0686* (2013.01); *G09G 2330/028* (2013.01)

(58) Field of Classification Search
CPC . G09G 3/3258; G09G 3/3208; G09G 3/3241; G09G 3/3225; G09G 3/32; G09G 2300/0426; G09G 2330/028; G09G 2320/0233
See application file for complete search history.

(56) References Cited

U.S. PATENT DOCUMENTS

2005/0057461 A1* 3/2005 Suh ..... G09G 3/3225 345/76
2006/0077144 A1* 4/2006 Eom ..... G09G 3/32 345/82
2008/0169822 A1* 7/2008 Kwak ..... G09G 3/006 324/537
2014/0313242 A1* 10/2014 Kaplan ..... G09G 3/3208 345/694

FOREIGN PATENT DOCUMENTS

KR 10-0525810 B1 10/2005
KR 10-0683677 B1 2/2007
KR 10-0700653 B1 3/2007
KR 10-2012-0019016 A 3/2012

* cited by examiner

*Primary Examiner* — Fred Tzeng
(74) *Attorney, Agent, or Firm* — Knobbe Martens Olson & Bear LLP

(57) ABSTRACT

An organic light-emitting diode display is disclosed. In one aspect, the display includes a display panel including pixels and having first and second end portions opposing each other, and a center portion therebetween. First and second power supply voltage lines extend from the first end portions to the second end portions. A third power supply voltage line having first and second ends are respectively formed in the first and center portions. A fourth power supply voltage line has first and second ends respectively formed in the first and second end portions. A power supply unit is formed adjacent to the first end portion and configured to apply a first power supply voltage to the first ends of the first and second power supply voltage lines and a second power supply voltage to the first end of the third power supply voltage line.

20 Claims, 12 Drawing Sheets

ORGANIC LIGHT-EMITTING DIODE DISPLAY

CROSS REFERENCE TO RELATED APPLICATION

This application claims priority under 35 U.S.C. §119 to Korean Patent Application No. 10-2014-0085980 filed on Jul. 9, 2014, the disclosure of which is hereby incorporated by reference herein in its entirety.

BACKGROUND

1. Field

The described technology generally relates to organic light-emitting diode displays.

2. Description of the Related Technology

Flat panel displays (FPDs) are widely used in electronic devices because FPDs are lightweight and thin compared to cathode-ray tube (CRT) displays. Typical exemplary technologies are liquid crystal display (LCD) and organic light-emitting diode (OLED) display. Compared to an LCD, an OLED display has many favorable characteristics such as a higher luminance and a wider viewing angle. In addition, OLED displays can be made thinner because they do not require a backlight. In the OLED display, electrons and holes are injected into a thin organic layer through a cathode and an anode, and then recombined in the thin organic layer to generate excitons, thereby emitting light of a certain wavelength.

SUMMARY OF CERTAIN INVENTIVE ASPECTS

One inventive aspect is an OLED display having a power supply unit that can increase luminance of the center of a display panel.

Another aspect is an OLED display having a power supply unit that can reduce the deterioration of a top portion of a display panel and a bottom portion of a display panel.

Another aspect is an OLED display which includes a display panel, a first power supply voltage line, a second power supply voltage, a third power supply voltage line, a fourth power supply voltage line, and a power supply unit. The display panel includes a plurality of pixels. The display panel includes a first end portion, a second end portion opposite to the first end portion, and a center portion positioned between the first end portion and the second end portion. The first power supply voltage line includes a first end positioned in the first end portion and a second end positioned in the second end portion. The second power supply voltage line includes a first end positioned in the first end portion and a second end connected to the second end of the first power supply voltage line in the second end portion. The second power supply voltage line is connected to the pixels. The third power supply voltage line includes a first end positioned in the first end portion and a second end positioned in the center portion. The fourth power supply voltage line includes a first end positioned in the first end portion and a second end positioned in the second end portion. The fourth power supply voltage line is connected to the second end of the third power supply voltage line in the center portion. The fourth power supply voltage line is connected to the pixels. The power supply unit is positioned adjacent to the first end portion. The power supply unit is configured to apply a first power supply voltage to the first end of the first power supply voltage line and the first end of the second power supply voltage line. The power supply unit is configured to apply a second power supply voltage to the first end of the third power supply voltage line.

The first power supply voltage applied to the first end of the first power supply voltage line can be provided to the pixels in a first direction from the second end portion of the display panel to the first end portion of the display panel via the first power supply voltage line, the second end of the first power supply voltage line, the second end of the second power supply voltage line, and the second power supply voltage line.

The first power supply voltage applied to the first end of the second power supply voltage line can be provided to the pixels in a second direction from the first end portion of the display panel to the second end portion of the display panel via the second power supply voltage line.

The second power supply voltage applied to the first end of the third power supply voltage line can be provided to the pixels in a third direction from the center portion of the display panel to the first end portion of the display panel and in a fourth direction from the center portion of the display panel to the second end portion of the display panel via the third power supply voltage line, the second end of the third power supply voltage line, and the fourth power supply voltage line.

Each of the pixels can include an anode electrode, a cathode electrode, and an emission layer. The anode electrode can be connected to the second power supply voltage line. The cathode electrode can be opposite to the anode electrode, and the cathode electrode can be connected to the fourth power supply voltage line. The emission layer can be positioned between the anode electrode and the cathode electrode.

The each of pixels can include an anode electrode, a cathode electrode, and an emission layer. The anode electrode can be connected to the fourth power supply voltage line. The cathode electrode can be opposite to the anode electrode, and the cathode electrode can be connected to the second power supply voltage line. The emission layer can be positioned between the anode electrode and the cathode electrode.

The OLED display can further include a resistance structure disposed between the power supply unit and the first end of the second power supply voltage line such that a voltage level of the first power supply voltage provided to the first end of the second power supply voltage line via the resistance structure is substantially the same as a voltage level of the first power supply voltage provided to the second end of the second power supply voltage line via the first power supply voltage line.

The resistance structure can include at least one selected from an S-shaped electrode pattern, an electrode pattern having a thickness less than that of the first power supply voltage line, an electrode pattern having a width less than that of the first power supply voltage line, and a bridge connected to the second power supply voltage line via a contact.

The OLED display can be driven by a digital driving method.

The first power supply voltage can be a high power supply voltage, and the second power supply voltage can be a low power supply voltage.

The first power supply voltage can be a low power supply voltage, and the second power supply voltage can be a high power supply voltage.

The OLED display can further include a scan driving unit, a data driving unit, and a timing control unit. The scan driving unit can be configured to provide a scan signal to the pixels via a plurality of scan lines. The data driving unit can be configured to provide a data signal to the pixels via a plurality of data lines. The timing control unit can be configured to control the scan driving unit, the data driving unit, and the power supply unit.

The luminance of at least one of the pixels positioned in the center portion of the display panel can be higher than a luminance of at least one of the pixels positioned in the first end portion or the second end portion.

Another aspect is an OLED display which includes a display panel, a first power supply voltage line, a second power supply voltage, a third power supply voltage line, a fourth power supply voltage line, and a power supply unit. The display panel includes a plurality of pixels. The display panel includes a first end portion, a second end portion opposite to the first end portion and a center portion positioned between the first end portion and the second end portion. The first power supply voltage line extends from the first end portion to the second end portion. The second power supply voltage line extends from the first end portion to the second end portion. The second power supply voltage line is connected to the first power supply voltage line in the second end portion, and the second power supply voltage line is connected to the pixels. The third power supply voltage line extends from the first end portion to the center portion. The fourth power supply voltage line extends from the first end portion to the second end portion. The fourth power supply voltage line is connected to the third power supply voltage line in the center portion, and the fourth power supply voltage line is connected to the pixels. The power supply unit is positioned adjacent to the first end portion. The power supply unit is configured to provide a first power supply voltage to the pixels in a first direction from the second end portion to the first end portion by applying the first power supply voltage to the first power supply voltage line. The power supply unit is configured to provide the first power supply voltage to the pixels in a second direction from the first end portion to the second end portion by applying the second power supply voltage to the second power supply voltage line. The power supply unit is configured to provide a second power supply voltage to the pixels in a third direction from the center portion to the first end portion and in a fourth direction from the center portion to the second end portion by applying the second power supply voltage to the third power supply voltage line.

Each of the pixels can include an anode electrode, a cathode electrode, and an emission layer. The anode electrode can be connected to the second power supply voltage line. The cathode electrode can be opposite to the anode electrode, and the cathode electrode can be connected to the fourth power supply voltage line. The emission layer can be positioned between the anode electrode and the cathode electrode.

The each of pixels can include an anode electrode, a cathode electrode, and an emission layer. The anode electrode can be connected to the fourth power supply voltage line. The cathode electrode can be opposite to the anode electrode, and the cathode electrode can be connected to the second power supply voltage line. The emission layer can be positioned between the anode electrode and the cathode electrode.

The OLED display can further include a resistance structure disposed between the power supply unit and the first end of the second power supply voltage line such that a voltage level of the first power supply voltage provided to the first end of the second power supply voltage line via the resistance structure is substantially the same as a voltage level of the first power supply voltage provided to the second end of the second power supply voltage line via the first power supply voltage line.

The resistance structure can include at least one selected from an S-shaped electrode pattern, an electrode pattern having a thickness less than that of the first power supply voltage line, an electrode pattern having a width less than that of the first power supply voltage line, and a bridge connected to the second power supply voltage line via a contact.

The OLED display can be driven by a digital driving method.

The first power supply voltage can be a high power supply voltage, and the second power supply voltage can be a low power supply voltage.

The first power supply voltage can be a low power supply voltage, and the second power supply voltage can be a high power supply voltage.

Another aspect is an organic light-emitting diode (OLED) display comprising a display panel comprising a plurality of pixels and having first and second end portions opposing each other, and a center portion therebetween, a first power supply voltage line extending from the first end portion to the second end portion, and a second power supply voltage line extending from the first end portion to the second end portion, wherein the second power supply voltage line is electrically connected to the pixels. The display further comprises a third power supply voltage line having first and second ends respectively formed in the first and center portions and a fourth power supply voltage line having first and second ends respectively formed in the first and second end portions, wherein the fourth power supply voltage line is electrically connected to the pixels and the second end of the third power supply voltage line. The display further comprises a power supply unit formed adjacent to the first end portion and configured to apply i) a first power supply voltage to the first ends of the first and second power supply voltage lines and ii) a second power supply voltage to the first end of the third power supply voltage line.

In the above display, the power supply unit is further configured to supply the first power supply voltage to the pixels in a first direction extending from the second end portion to the first end portion of via the first power supply voltage line, the second end of the first power supply voltage line, the second end of the second power supply voltage line, and the second power supply voltage line, wherein the power supply unit is further configured to supply the first power supply voltage to the pixels in a second direction extending from the first end portion to the second end portion via the second power supply voltage line.

In the above display, the power supply unit is further configured to supply the second power supply voltage to the pixels in a third direction extending from the center portion to the first end portion and in a fourth direction extending from the center portion to the second end portion via the third power supply voltage line, the second end of the third power supply voltage line, and the fourth power supply voltage line.

In the above display, each of the pixels includes an anode electrode electrically connected to the second power supply voltage line, a cathode electrode opposite to the anode electrode and electrically connected to the fourth power supply voltage line, and an emission layer formed between the anode and cathode electrodes.

In the above display, each of the pixels includes an anode electrode electrically connected to the fourth power supply voltage line, a cathode electrode opposite to the anode electrode and electrically connected to the second power supply voltage line, and an emission layer formed between the anode and cathode electrodes.

The above display further comprises a resistance structure formed adjacent to the power supply unit such that a voltage level of the first power supply voltage provided to the second power supply voltage line via the resistance structure is substantially the same as a voltage level of the first power supply voltage provided to the second power supply voltage line via the first power supply voltage line.

In the above display, the resistance structure includes at least one of the following: an S-shaped electrode pattern, an electrode pattern having a thickness less than that of the first power supply voltage line, an electrode pattern having a width less than that of the first power supply voltage line, and a bridge electrically connected to the second power supply voltage line via a contact.

In the above display, the display is configured to be driven by a digital driving method.

In the above display, the first power supply voltage includes a logical high power supply voltage, wherein the second power supply voltage includes a logical low power supply voltage.

In the above display, the first power supply voltage includes a logical low power supply voltage, wherein the second power supply voltage includes a logical high power supply voltage.

The above display further comprises a scan driver configured to provide a scan signal to the pixels via a plurality of scan lines, a data driver configured to provide a data signal to the pixels via a plurality of data lines, and a timing controller configured to control the scan driver, the data driver, and the power supply unit.

In the above display, the luminance of at least one of the pixels formed in the center portion is higher than the luminance of at least one of the pixels formed in the first or second end portion.

Another aspect is an organic light-emitting diode (OLED) display comprising a display panel comprising a plurality of pixels and having first and second end portion opposing each other and a center portion therebetween, a first power supply voltage line extending from the first end portion to the second end portion and a second power supply voltage line electrically connected to the pixels and extending from the first end portion to the second end portion, wherein the second power supply voltage line is electrically connected to the first power supply voltage line in the second end portion. The display further comprises a third power supply voltage line extending from the first end portion to the center portion and a fourth power supply voltage line electrically connected to the pixels and extending from the first end portion to the second end portion, wherein the fourth power supply voltage line is electrically connected to the third power supply voltage line in the center portion. The display further comprises a power supply unit formed adjacent to the first end portion and configured to i) apply a first power supply voltage to the first power supply voltage line so as to provide the first power supply voltage to the pixels in a first direction extending from the second end portion to the first end portion, ii) apply a second power supply voltage to the second power supply voltage line so as to provide the second power supply voltage to the pixels in a second direction extending from the first end portion to the second end portion, and iii) apply the second power supply voltage to the third power supply voltage line so as to provide the second power supply voltage to the pixels in a third direction extending from the center portion to the first end portion and in a fourth direction extending from the center portion to the second end portion.

In the above display, each of the pixels includes an anode electrode electrically connected to the second power supply voltage line, a cathode electrode opposite to the anode electrode and electrically connected to the fourth power supply voltage line, and an emission layer formed between the anode and cathode electrodes.

In the above display, each of the pixels includes an anode electrode electrically connected to the fourth power supply voltage line, a cathode electrode opposite to the anode electrode and electrically connected to the second power supply voltage line, and an emission layer formed between the anode and cathode electrodes.

The above display further comprises a resistance structure adjacent to the power supply unit such that a voltage level of the first power supply provided to the second power supply voltage line via the resistance structure is substantially the same as a voltage level of the first power supply voltage provided to the second power supply voltage line via the first power supply voltage line.

In the above display, the resistance structure includes at least one of the following: an S-shaped electrode pattern, an electrode pattern having a thickness less than that of the first power supply voltage line, an electrode pattern having a width less than that of the first power supply voltage line, and a bridge electrically connected to the second power supply voltage line via a contact.

In the above display, the OLED display is configured to be driven by a digital driving method.

In the above display, the first power supply voltage includes a logical high power supply voltage, wherein the second power supply voltage includes a logical low power supply voltage.

In the above display, the first power supply voltage includes a logical low power supply voltage, wherein the second power supply voltage includes a logical high power supply voltage.

According to at least one of the disclosed embodiments, as the OLED display increases a luminance of a center portion of a display panel, an image sticking phenomenon can be prevented.

In addition, as the OLED display according to at least one disclosed embodiment increases a luminance of a center portion of a display panel, a deterioration of a top portion of a display panel and a bottom portion of a display panel can be decreased.

DETAILED DESCRIPTION OF CERTAIN INVENTIVE EMBODIMENTS

Figure 1:
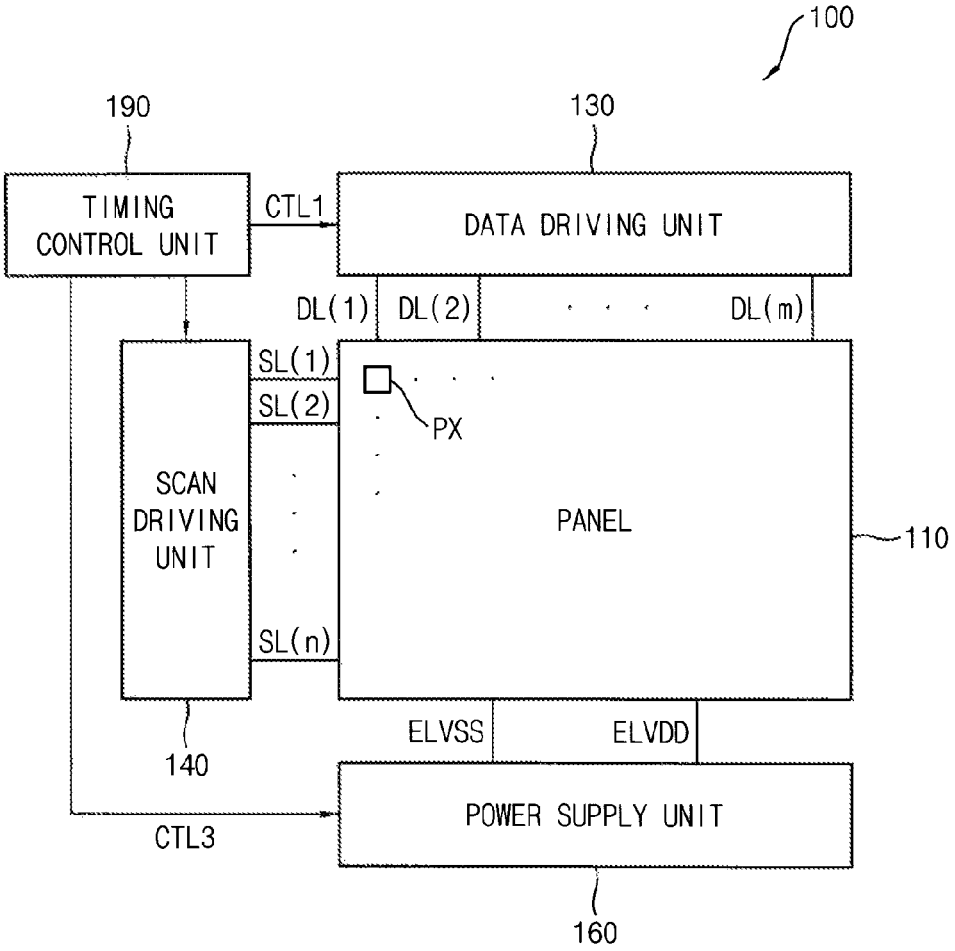
FIG. 1 is a block diagram illustrating an organic light-emitting diode display in accordance.

As OLED displays have become larger, the IR-drop of the power supply voltage has increased. The IR-drop degrades luminance uniformity. In order to reduce the IR-drop, a dual bank method display where a power supply unit and a data driving unit are positioned in both sides of the display panel has been developed. However, even when using the dual bank method display, luminance can have a gradual reduction from top and bottom portions to the center portion of the display panel. Further, in this case, so-called image sticking can occur at those display portions, and the top and bottom portions of the display panel can, thus, readily degrade. Compared to a single bank method, the dual bank method can require many components (e.g., the data driving unit and the power supply unit). Thus, manufacturing costs, as well as dead space, can increase.

Hereinafter, example embodiments will be described in detail with reference to the accompanying drawings. In the drawings, identical or similar reference numerals can represent identical or similar elements. In this disclosure, the term "substantially" includes the meanings of completely, almost completely or to any significant degree under some applications and in accordance with those skilled in the art. Moreover, "formed on" can also mean "formed over." The term "connected" can include an electrical connection.

FIG. 1 is a block diagram illustrating an OLED display in accordance with example embodiments.

Referring to FIG. 1, an OLED display 100 includes a display panel 110, a data driving unit or data driver 130, a scan driving unit or scan driver 140, a power supply unit 160, and a timing control unit or timing controller 190.

The display panel 110 is electrically connected to the scan driving unit 140 via scan-lines SL(1) through SL(n), and is electrically connected to the data driving unit 130 via data-lines DL(1) through DL(m). In addition, the display panel 110 is electrically connected to the power supply unit 160 via first through fourth power supply voltage lines. Further, the display panel 110 includes n*m pixels PX because the pixels PX are arranged at locations corresponding to crossing points of the scan-lines SL(1) through SL(n) and the data-lines DL(1) through DL(m).

The data driving unit 130 can provide a data signal to each of the pixels PX via the data-lines DL(1) through DL(m). For example, the data driving unit 130 outputs a data signal to display panel 110 based at least in part on a first timing control signal CTL1 of the timing control unit 190.

The scan driving unit 140 can provide a scan signal to each of the pixels PX via the scan-lines SL(1) through SL(n). For example, the scan driving unit 140 can sequentially output a scan signal to the display panel 110 based at least in part on a second timing control signal CTL2 of the timing control unit 190. In some embodiments, the OLED display 100 can further include an additional scan driving unit 140. When the OLED display 100 is larger, two scan driving unit 140 can be positioned in both side portions of the display panel 110 (i. e., display panel is positioned between scan driving units).

The timing control unit 190 can generate first through third timing control signals CTL1, CTL2, and CTL3. As the timing control unit 190 provides the first through third timing control signals CTL1, CTL2, and CTL3 to the data driving unit 130, the scan driving unit 140, and the power supply unit 160, the timing control unit 190 can control the data driving unit 130, the scan driving unit 140, and the power supply unit 160. For example, as the timing control unit 190 provides the second timing control signal CTL2 to the scan driving unit 140, the timing control unit 190 controls the scan driving unit 140 such that the scan driving unit 140 sequentially outputs the scan signals to the display panel 110. In addition, as the timing control unit 190 provides the first timing control signal CTL1 to the data driving unit 130, the timing control unit 190 controls the data driving unit 130 such that the data driving unit 130 outputs each of the data signals corresponding to the pixel PX of the display panel 110. Further, as the timing control unit 190 provides the third timing control signal CTL3 to the power supply unit 160, the timing control unit 190 controls the power supply unit 160 such that the power supply unit 160 outputs a high power supply voltage ELVDD and a low power supply voltage ELVSS to the pixel PX of the display panel 110.

The power supply unit 160 can include the first through fourth power supply voltage lines. The power supply unit 160 can provide the high power supply voltage ELVDD and the low power supply voltage ELVSS to each of the pixels PX via the first through fourth power supply voltage lines. The OLED display 100 including the first through fourth power supply voltage lines can be operated such that a luminance of substantially the center of the display panel 110 is greater than that of top and bottom of the display panel 110. In example embodiments, the OLED display 100 further includes an emission driving unit. The emission driving unit can sequentially or substantially simultaneously provide the emission control signals to display panel 110 via an emission control lines.

Figure 2:
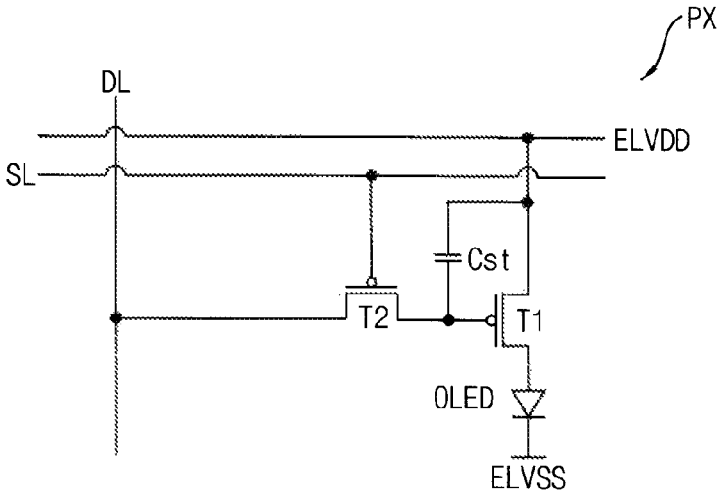
FIG. 2 is a circuit diagram illustrating an example of a pixel included in an organic light-emitting diode display of FIG. 1.

FIG. 2 is a circuit diagram illustrating an example of a pixel included in an OLED display of FIG. 1.

Referring to FIGS. 1 and 2, a pixel PX includes a driving transistor T1, a switching transistor T2, a storage capacitor Cst, and an OLED.

The switching transistor T2 includes a control electrode electrically connected to the scan line SL to which the scan signal is applied, an input electrode electrically connected to the data line DL to which the data voltage is applied, and an output electrode electrically connected to a first node N1.

The switching transistor T2 is turned on and turned off based at least in part on the scan signal. When the switching transistor T2 is turned on, the data voltage is applied to the first node N1.

The control electrode of the switching transistor T2 can be a gate electrode. The input electrode of the switching transistor T2 can be a source electrode. The output electrode of the switching transistor T2 can be a drain electrode.

In example embodiment, the switching transistor T2 is a P-type transistor, but the switching transistor T2 is not limited thereto. The switching transistor T2 can be turned on when the scan signal has a low level.

The driving transistor T1 includes a control electrode electrically connected to the first node N1, an input electrode to which a high power supply voltage ELVDD is applied, and an output electrode electrically connected to an anode electrode of the OLED.

Since the pixel PX is driven by a digital driving method, the driving transistor T1 is operated in a linear region. Thus, the driving transistor T1 is turned on and turned off based at least in part on a voltage at the first node N1. When the driving transistor T1 is turned on, the high power supply voltage ELVDD is applied to the anode electrode of the OLED.

The control electrode of the driving transistor T1 can be a gate electrode. The input electrode of the driving transistor T1 can be a source electrode. The output electrode of the driving transistor T1 can be a drain electrode.

In example embodiment, the driving transistor T1 is a P-type transistor, but the driving transistor T1 is not limited thereto. The driving transistor T1 can be turned on when the voltage at the first node N1 is less than a turn on voltage of the first driving transistor T1.

The data signal can be applied to the storage capacitor Cst during a turn-on period of the scan signal SCAN. The storage capacitor Cst can store the applied data signal. The applied data signal can be maintained during a turn-off period of the scan signal.

The OLED includes the anode electrode electrically connected to the output electrode of the driving transistor T1 and a cathode electrode to which a low power supply voltage ELVSS is applied.

When a difference between a voltage at the anode electrode and a voltage at the cathode electrode is substantially equal to or greater than a threshold voltage, the OLED is turned on. When the difference between the voltage at the anode electrode and the voltage at the cathode electrode is less than the threshold voltage, the OLED is turned off.

The pixel PX of FIG. 1 can include various pixels other than the pixel of FIG. 2.

Figure 3:
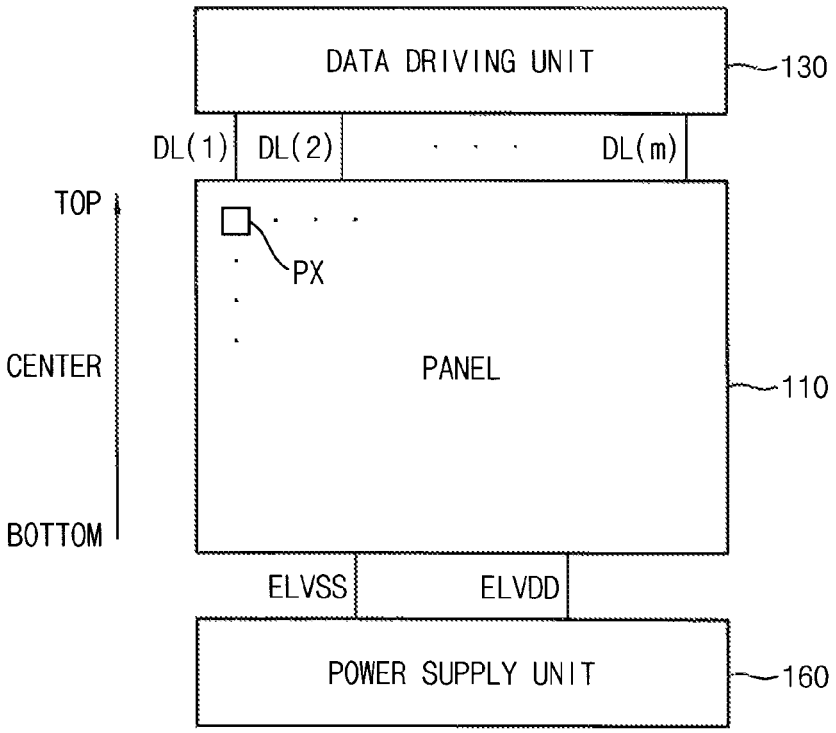
FIG. 3 is a block diagram for describing a bottom portion, a center portion, and a top portion of a display panel illustrated in FIG. 1.

FIG. 3 is a block diagram for describing a bottom portion, a center portion, and a top portion of the display panel 110 illustrated in FIG. 1.

Referring to FIGS. 1 and 3, a display panel 110 can separate a first end portion BOTTOM, a center portion CENTER, and a second end portion TOP. For example, the first end portion BOTTOM is positioned opposite to the second end portion TOP. The center portion CENTER can be positioned between the first end portion BOTTOM and the second end portion TOP. The second end portion TOP can be positioned adjacent to a data driving unit 130. The first end portion BOTTOM can be positioned adjacent to a power supply unit 160. In example embodiments, the high power supply voltage ELVDD and the low power supply voltage ELVSS can be provided to the pixels PX from the first end portion BOTTOM to the second end portion TOP through the center portion CENTER via the first through fourth power supply voltage lines.

Figure 4:
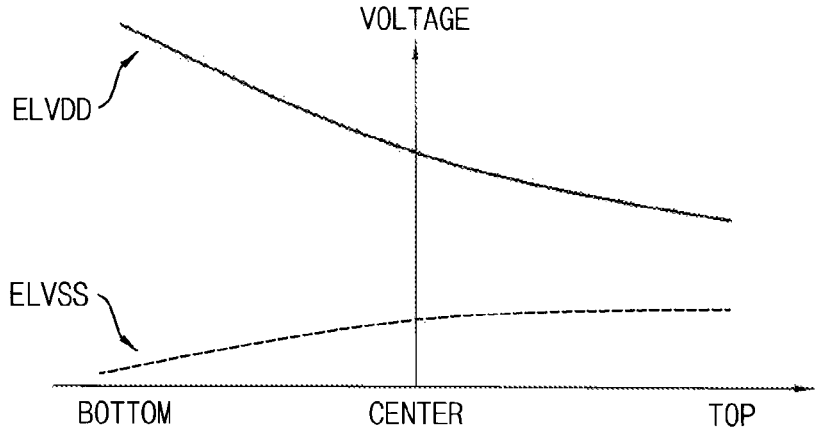
FIG. 4 is a graph illustrating an example of a high power supply voltage and a low power supply voltage when the display panel is driven by a single bank method.

FIG. 4 is a graph illustrating an example of a high power supply voltage and a low power supply voltage when the display panel 110 is driven by a single bank method. The vertical axis of FIG. 4 represents a magnitude of a voltage level, and the horizontal axis represents the first end portion BOTTOM, the center portion CENTER, and the second end portion TOP of a display panel 110 illustrated in FIG. 3.

Referring to FIGS. 3 and 4, when the OLED display 100 is driven by the single bank method, the power supply unit 160 can be positioned adjacent to the first end portion BOTTOM (or the second end portion TOP). In this case, a high power supply voltage ELVDD is applied to the first end portion BOTTOM. Here, a voltage level of the high power supply voltage ELVDD can be decreased by an IR drop because the high power supply voltage ELVDD is passed from the first end portion BOTTOM to the second end portion TOP through the center portion CENTER. Meanwhile, a low power supply voltage ELVSS can be applied to the first end portion BOTTOM. Here, a voltage level of the low power supply voltage ELVSS can be increased by the IR drop because the low power supply voltage ELVSS is passed from the first end portion BOTTOM to the second end portion TOP through the center portion CENTER. When the OLED display 100 is driven by a digital driving method, a difference of the high power supply voltage ELVDD and the low power supply voltage ELVSS can be defined as a luminance. As illustrated in FIG. 4, a long range uniformity (LRU) of the display panel 110 can be reduced, considering the difference of the high power supply voltage ELVDD and the low power supply voltage ELVSS. That is, a luminance of the first end portion BOTTOM can be high, and the luminance can be gradually low toward a direction from the first end portion BOTTOM to the second end portion TOP. However, compared to the dual bank method, the single bank method can reduce a dead space. As the OLED display 100 becomes larger, the problem can be more serious.

Figure 5:
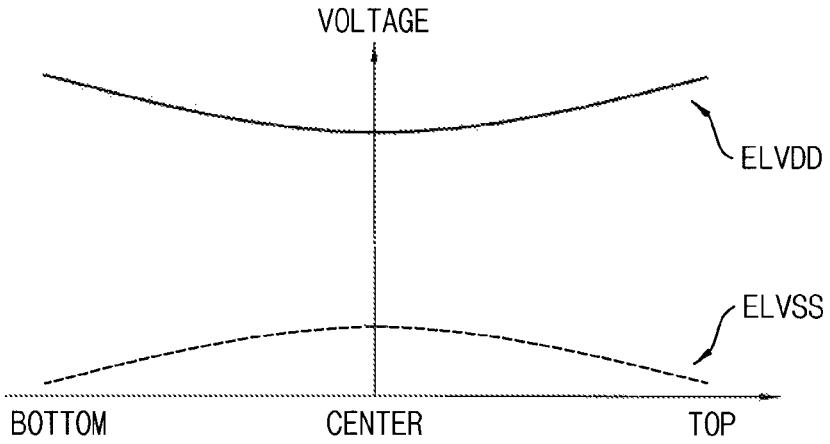
FIG. 5 is a graph illustrating an example of a high power supply voltage and a low power supply voltage when the display panel is driven by a dual bank method.

FIG. 5 is a graph illustrating an example of a high power supply voltage and a low power supply voltage when the display panel is driven by the dual bank method. The vertical axis of FIG. 5 represents magnitude of a voltage level, and the horizontal axis represents a first end portion BOTTOM, a center portion CENTER, and a second end portion TOP of a display panel 110 illustrated in FIG. 3.

Referring to FIGS. 3 and 5, when the OLED display 100 is driven by the dual bank method, two power supply units 160 can be positioned adjacent to the first end portion BOTTOM and the second end portion TOP, respectively. In this case, a high power supply voltage ELVDD is substantially simultaneously applied to the first end portion BOTTOM and the second end portion TOP. Here, a voltage level of the high power supply voltage ELVDD can be decreased by an IR drop because the high power supply voltage ELVDD is passed from the second end portion TOP to the center portion CENTER. Similarly, a voltage level of the high power supply voltage ELVDD can be decreased by an IR drop because the high power supply voltage ELVDD is passed from the first end portion BOTTOM to the center portion CENTER. Meanwhile, a low power supply voltage ELVSS can be substantially simultaneously applied to the first end portion BOTTOM and the second end portion TOP. Here, a voltage level of the low power supply voltage ELVSS can be increased by an IR drop because the low power supply voltage ELVSS is passed from the second end portion TOP to the center portion CENTER. Similarly, a voltage level of the low power supply voltage ELVSS can be increased by an IR drop because the low power supply voltage ELVSS is passed from the first end portion BOTTOM to the center portion CENTER. When the OLED display 100 is driven by the digital driving method, a difference of the high power supply voltage ELVDD and the low power supply voltage ELVSS can be defined as a luminance. As illustrated in FIG. 5, the luminance of the first end portion BOTTOM and the second end portion TOP can be high, and a luminance of the center portion CENTER can be low, considering the difference of the high power supply voltage ELVDD and the low power supply voltage ELVSS. Compared to the single bank method, the LRU can be improved. However, an afterimage of an image sticking pattern (e.g., a logo of a broadcaster etc.) can remain. In addition, a voltage level applied to the first end portion BOTTOM and the second end portion TOP can be higher than a voltage level applied to the center portion CENTER. Thus, compared to the center portion CENTER, components positioned in the first end portion BOTTOM and the second end portion TOP can be quickly deteriorated. Further, when a user of the OLED display 100 watches a movie using a wide screen display, the first and second end portions BOTTOM and TOP which are high luminance regions can be black. The center portion CENTER which is a low luminance region can display an image. Thus, in this case, the OLED display 100 can be inefficiently operated. Furthermore, the dual bank method OLED display 100 can include many components such as additional power supply unit 160, additional data driving unit 130, etc. A manufacturing cost of the OLED display 100 can be increased. In addition, when the many components are added to the OLED display 100, a dead space of the OLED display 100 can be increased. As the OLED display 100 becomes larger, the problem can be more serious.

Figure 6:
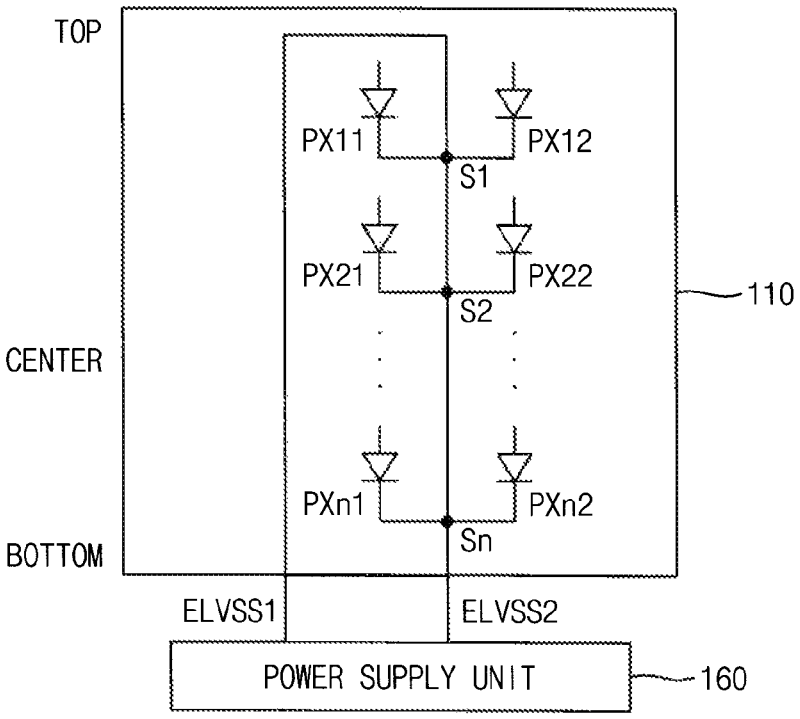
FIG. 6 is a diagram illustrating an example of a low power supply voltage line included in an organic light-emitting diode display in accordance with example embodiments.
Figure 7:
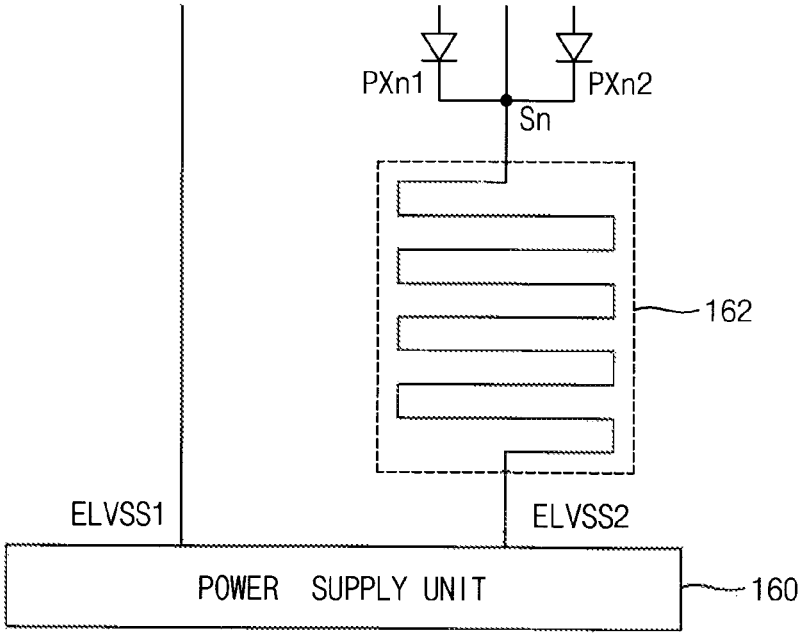
FIG. 7 is a diagram illustrating an example of a resistance structure included in an organic light-emitting diode display in accordance with example embodiments.
Figure 8:
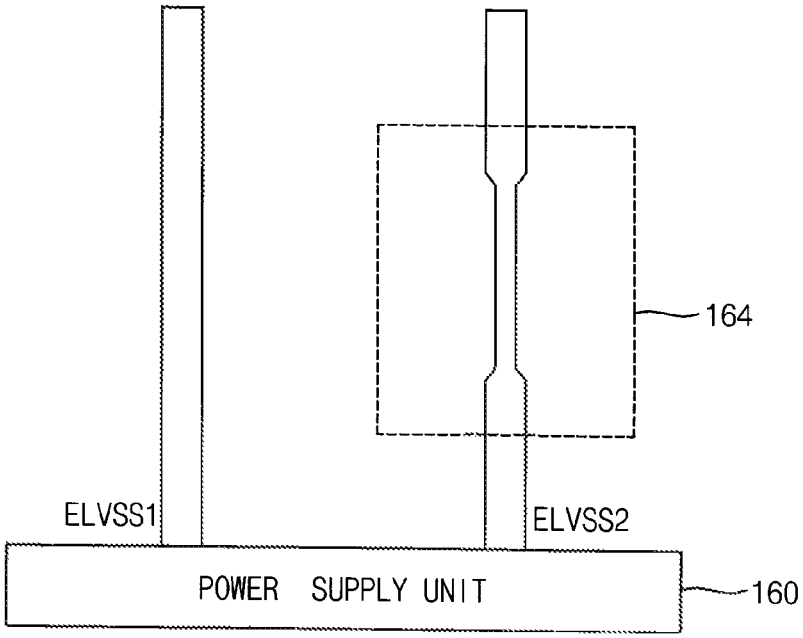
FIG. 8 is a diagram illustrating another example of a resistance structure included in an organic light-emitting diode display in accordance with example embodiments.
Figure 9:
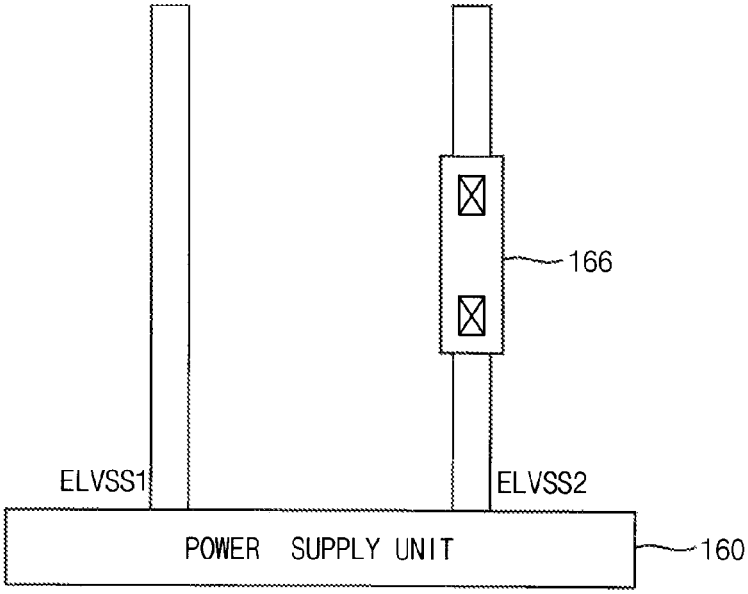
FIG. 9 is a diagram illustrating still another example of a resistance structure in an organic light-emitting diode display in accordance with example embodiments.

FIG. 6 is a diagram illustrating an example of a low power supply voltage line included in an OLED display in accordance with example embodiments. FIG. 7 is a diagram illustrating an example of a resistance structure included in an OLED display in accordance with example embodiments. FIG. 8 is a diagram illustrating another example of a resistance structure included in an OLED display in accordance with example embodiments. FIG. 9 is a diagram illustrating still another example of a resistance structure in an OLED display in accordance with example embodiments.

Referring to FIGS. 3 and 6 through 9, the display panel 110 includes the first end portion BOTTOM, the center portion CENTER, and the second end portion TOP. The power supply unit 160 can include a first power supply voltage line ELVSS1, a second power supply voltage line ELVSS2, a third power supply voltage line ELVDD1 (shown in FIG. 10), and a fourth power supply voltage line ELVDD2 (shown in FIG. 10). Here, the first power supply voltage line ELVSS1 can include a first end positioned in the first end portion BOTTOM and a second end positioned in the second end portion TOP. The second power supply voltage line ELVSS2 can include a first end positioned in the first end portion BOTTOM and a second end positioned in the second end portion TOP. Here, the second end of the second power supply voltage line ELVSS2 can be electrically connected to the second end of the first power supply voltage line ELVSS1. In addition, the second power supply voltage line ELVSS2 can be electrically connected to pixels PX. The third power supply voltage line ELVDD1 can include a first end positioned in the first end portion BOTTOM and a second end positioned in the center portion CENTER. The fourth power supply voltage line ELVDD2 can include a first end positioned in the first end portion BOTTOM and a second end positioned in the second end portion TOP. Here, the fourth power supply voltage line ELVDD2 can be electrically connected to the second end of the third power supply voltage line ELVDD1 in the center portion CENTER, and the fourth power supply voltage line ELVDD2 can be electrically connected to the pixels PX. The power supply unit 160 can generate a first power voltage and a second power voltage. The power supply unit 160 can be positioned adjacent to the first end portion BOTTOM. The power supply unit 160 can provide the first power voltage to the first end of the first power supply voltage line ELVSS1 and the first end of the second power supply voltage line ELVSS2, and can provide the second power voltage to the first end of the third power supply voltage line ELVDD1. In example embodiments, the first power voltage can be a low power supply voltage ELVSS, and the second power voltage can be a high power supply voltage ELVDD.

The first power voltage can be provided from the second end portion TOP and the first end portion BOTTOM to the center portion CENTER via the first power supply voltage line ELVSS1 and the second power supply voltage line ELVSS2. For example, the first power voltage applied to the first end of the first power supply voltage line ELVSS1 is provided to the pixels PX in a direction from the second end portion TOP to the first end portion BOTTOM via the first power supply voltage line ELVSS1, the second end of the first power supply voltage line ELVSS1, the second end of the second power supply voltage line ELVSS2, and the second power supply voltage line ELVSS2. Here, the direction can be defined as a first direction. In addition, the first power voltage applied to the first end of the second power supply voltage line ELVSS2 can be provided to the pixels PX in a direction from the first end portion BOTTOM to the second end portion TOP via the second power supply voltage line ELVSS2. Here, the direction can be defined as a second direction. Accordingly, the first power voltage can be provided to the pixels PX. A voltage level of the first power voltage applied in the first end portion BOTTOM of the first power supply voltage line ELVSS1 and the second power supply voltage line ELVSS2 can be substantially the same. In example embodiments, the first power supply voltage line ELVSS1 includes the first end positioned in the first end portion BOTTOM and the second end positioned in the second end portion TOP. Here, the first end of the first power supply voltage line ELVSS1 can be electrically connected to the power supply unit 160, and the second end of the first power supply voltage line ELVSS1 can be electrically connected to the second end of the second power supply voltage line ELVSS2. The second power supply voltage line ELVSS2 can include the first end positioned in the first end portion BOTTOM and the second end positioned in the second end portion TOP. Here, the first end of the second power supply voltage line ELVSS2 can be electrically connected to the power supply unit 160, and the second end of the second power supply voltage line ELVSS2 can be electrically connected to the second end of the first power supply voltage line ELVSS1. The first power voltage provided to the first end of the first power supply voltage line ELVSS1 can be passed from the first end portion BOTTOM to the second end portion TOP via the first power supply voltage line ELVSS1. In some embodiments, when the first power voltage is passed from the first end portion BOTTOM to the second end portion TOP via the first power supply voltage line ELVSS1, the first power supply voltage line ELVSS1 is not electrically connected to the pixels PX. At substantially the same time, the first power voltage provided to the second power supply voltage line ELVSS2 can be passed from the first end portion BOTTOM to the second end portion TOP. Here, as the first power voltage is passed in the second direction via the first power supply voltage line ELVSS1, an IR drop of the first power voltage can occur. Thus, to substantially equally provide a voltage level of the first power voltage applied to the pixels PX positioned adjacent to the first end portion BOTTOM and a voltage level of the first power voltage applied to the pixels PX positioned adjacent to the second end portion TOP, the second power supply voltage line ELVSS2 can further include a resistance structure. The resistance structure can be positioned between the power supply unit 160 and the second power supply voltage line ELVSS2 such that a voltage level of the first power supply voltage provided to the first end of the second power supply voltage line ELVSS2 via the resistance structure is substantially the same as a voltage level of the first power supply voltage provided to the second end of the second power supply voltage line ELVSS2 via the first power supply voltage line ELVSS1.

As illustrated in FIG. 7, a resistance structure 162 is positioned adjacent to the power supply unit 160. The resistance structure 162 can be an S-shaped electrode pattern. The width of the second power supply voltage line ELVSS2 can be substantially the same as the width of the resistance structure 162. As the second power supply voltage line ELVSS2 includes the resistance structure 162, the OLED display 100 can be substantially the same voltage level can be provided to the first and second ends of the second power supply voltage line ELVSS2 (i.e., substantially the same voltage level of the first power voltage can be provided to the first end portion BOTTOM and the second end portion TOP).

As illustrated in FIG. 8, a resistance structure 164 is positioned adjacent to the power supply unit 160. The resistance structure 164 can be an electrode pattern having a thickness less than that of the first power supply voltage line ELVSS1 and/or an electrode pattern having a width less than that of the first power supply voltage line ELVSS1. As the second power supply voltage line ELVSS2 includes the resistance structure 164, substantially the same voltage level of the first power voltage can be provided to the first end of the second power supply voltage line ELVSS2 and the second end of the second power supply voltage line ELVSS2.

As illustrated in FIG. 9, a resistance structure 166 is positioned adjacent to the power supply unit 160. The resistance structure 164 can be a bridge electrically connected to the second power supply voltage line ELVSS2 via a contact. In a process of manufacturing a thin film transistor (TFT), when an active layer of the TFT is formed, the resistance structure 166 can be substantially simultaneously formed. As the second power supply voltage line ELVSS2 includes the resistance structure 164, substantially the same voltage level of the first power voltage can be provided to the first end of the second power supply voltage line ELVSS2 and the second end of the second power supply voltage line ELVSS2.

Referring again to FIG. 6, the display panel 110 includes pixels PX11 through PXnm. For example, the pixel PX11 is electrically connected to a first scan line SL1 and a first data line DL1 and the pixel PX12 is electrically connected to the first scan line SL1 and a second data line DL2. Similarly, the pixel PXn1 can be electrically connected to an nth scan line SLn and the first data line DL1, and the pixel PXn2 can be electrically connected to the nth scan line SLn and the second data line DL2. The second power supply voltage line ELVSS2 can include a plurality of branch points. For example, the second power supply voltage line ELVSS2 includes a first branch point S1 through an nth branch point Sn. Here, the first branch point S1 can be electrically connected to the pixel PX11 and the pixel PX12, and the second branch point S2 can be electrically connected to the pixel PX21 and the pixel PX22. Similarly, the nth branch point Sn can be electrically connected to the pixel PXn1 and the pixel PXn2. For example, each of the pixels PX includes an anode electrode, a cathode electrode opposite to the anode, and an emission layer between the anode electrode and the cathode electrode. Each of the branch points S1 through Sn can be electrically connected to each of the cathode electrode of the pixels PX11 through PXnm.

The first power voltage transferred through the first power supply voltage line ELVSS1 can be applied to the pixel PX11 and the pixel PX12 via the first branch point S1 of the second power supply voltage line ELVSS2. That is, the first power voltage can be sequentially transferred from the pixel PX11 and the pixel PX12 to the pixels PX positioned in the center portion CENTER. In addition, the first power voltage transferred through the second power supply voltage line ELVSS2 can be applied to the pixel PXn1 and the pixel PXn2 via the nth branch point Sn of the second power supply voltage line ELVSS2. That is, the first power voltage can be sequentially transferred from the pixel PXn1 and the pixel PXn2 to the pixels PX positioned in the center portion CENTER. In this manner, the first power voltage can be transferred to the pixels PX11 through PXnm from the second end portion TOP and the first end portion BOTTOM to the center portion CENTER via the branch points S1 through Sn of the second power supply voltage line ELVSS2.

While one branch point as illustrated in FIG. 9 is electrically connected to two pixels, the branch point can be electrically connected to one pixel or at least two pixels.

Figure 10:
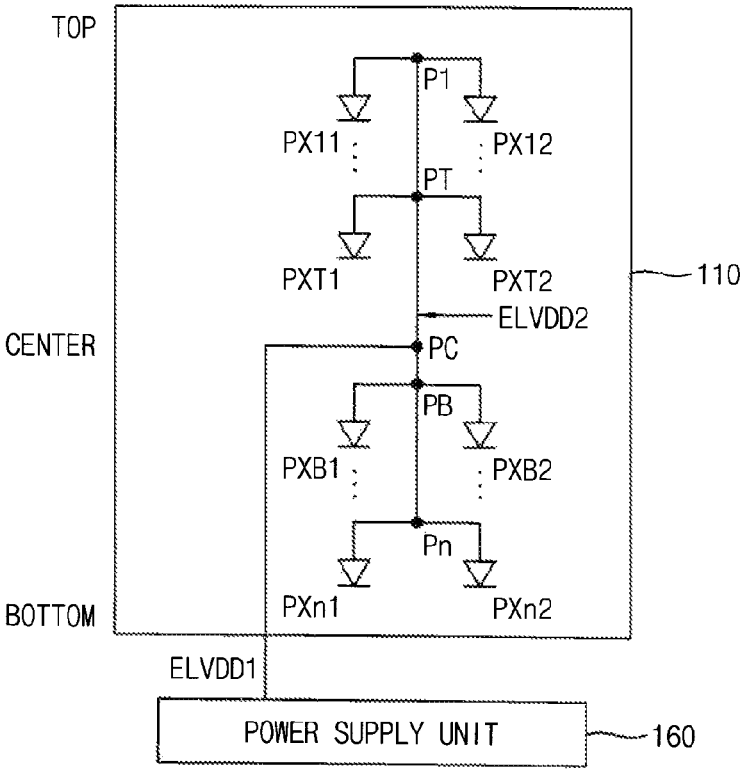
FIG. 10 is a diagram illustrating an example of a high power supply voltage line included in an organic light-emitting diode display in accordance with example embodiments.

FIG. 10 is a diagram illustrating an example of a high power supply voltage line included in an OLED display in accordance with example embodiments.

Referring to FIGS. 3 and 10, the display panel 110 can include a first end portion BOTTOM, a center portion CENTER, and a second end portion TOP. A power supply unit 160 includes the first power supply voltage line ELVSS1 (shown FIG. 6), the second power supply voltage line ELVSS2 (shown FIG. 6), a third power supply voltage line ELVDD1, and a fourth power supply voltage line ELVDD2. Here, the first power supply voltage line ELVSS1 can include a first end positioned in the first end portion BOTTOM and a second end positioned in the second end portion TOP. The second power supply voltage line ELVSS2 can include a first end positioned in the first end portion BOTTOM and a second end positioned in the second end portion TOP. Here, the second end of the second power supply voltage line ELVSS2 can be electrically connected to the second end of the first power supply voltage line ELVSS1 in the second end portion TOP. In addition, the second power supply voltage line ELVSS2 can be electrically connected to the pixels PX. The third power supply voltage line ELVDD1 can include a first end positioned in the first end portion BOTTOM and a second end positioned in the center portion CENTER. The fourth power supply voltage line ELVDD2 can include a first end positioned in the first end portion BOTTOM and a second end positioned in the second end portion TOP. Here, the fourth power supply voltage line ELVDD2 can be electrically connected to the second end of the third power supply voltage line ELVDD1 in the center portion CENTER, and the fourth power supply voltage line ELVDD2 can be electrically connected to the pixels PX. The power supply unit 160 can generate a first power voltage and second power voltage. The power supply unit 160 can be positioned adjacent to the first end portion BOTTOM. The power supply unit 160 can provide the first power voltage to the first ends of the first and second power supply voltage lines ELVSS1 and ELVSS2, and can provide the second power voltage to the first end of the third power supply voltage line ELVDD1. In example embodiments, the first power voltage can be a low power supply voltage ELVSS, and the second power voltage can be a high power supply voltage ELVDD.

The second power voltage can be transferred to a center branch point PC via the third power supply voltage line ELVDD1. The second power voltage can be provided from the center portion CENTER to the first and second end portions BOTTOM and TOP of the display panel 110. For example, the second power voltage applied to the first end of the third power supply voltage line ELVDD1 can be provided to the pixels PX in directions from the center portion CENTER to the first end portion BOTTOM and the second end portion TOP via the third power supply voltage line ELVDD1, the second end of the third power supply voltage line ELVDD1, and the fourth power supply voltage line ELVDD2. Here, the direction from the center portion CENTER to the first end portion BOTTOM can be defined as a third direction, and the direction from the center portion CENTER to the second end portion TOP can be defined as a fourth direction. Accordingly, the second power voltage can be provided to the pixels PX.

In example embodiments, the third power supply voltage line ELVDD1 can include the first end positioned in the first end portion BOTTOM and the second end positioned in the center portion CENTER. Here, the first end of the third power supply voltage line ELVDD1 can be electrically connected to the power supply unit 160, and the second end of the third power supply voltage line ELVDD1 can be electrically connected to the fourth power supply voltage line ELVDD2 in the center portion CENTER. The fourth power supply voltage line ELVDD2 can include the first end positioned in the first end portion BOTTOM and the second end positioned in the second end portion TOP. Here, the fourth power supply voltage line ELVDD2 can be electrically connected to the second end of the third power supply voltage line ELVDD1 in the center portion CENTER. The display panel 110 can include pixels PX11 through PXnm. For example, the pixel PX11 is electrically connected to a first scan line SL1 and a first data line DL1 and the pixel PX12 is electrically connected to the first scan line SL1 and a second data line DL2. Similarly, the pixel PXn1 can be electrically connected to an nth scan line SLn and the first data line DL1, and the pixel PXn2 can be electrically connected to the nth scan line SLn and the second data line DL2. The fourth power supply voltage line ELVDD2 can include a plurality of branch points. For example, the fourth power supply voltage line ELVDD2 can include a first branch point P1 through an nth branch point Pn. Here, the first branch point P1 can be electrically connected to the pixel PX11 and the pixel PX12, and the second branch point P2 can be electrically connected to the pixel PX21 and the pixel PX22. Similarly, the nth branch point Pn can be electrically connected to the pixel PXn1 and the pixel PXn2. For example, each of the pixels PX can include an anode electrode, a cathode electrode opposite to the anode, an emission layer between the anode electrode and the cathode electrode. Each of the branch points P1 through Pn can be electrically connected to each of the anode electrode of the pixels PX11 through PXnm. The fourth power supply voltage line ELVDD2 can further include a center branch point PC. The center branch point PC can be positioned in the center of the first branch point P1 through the nth branch point Pn. The third power supply voltage line ELVDD1 can be electrically connected to the fourth power supply voltage line ELVDD2 (e.g., the second end of the fourth power supply voltage line ELVDD2) via the center branch point PC. After the second power voltage transferred through the third power supply voltage line ELVDD1 is divided by the center branch point PC, the second power voltage can be provided to the pixels PXT1, PXT2, PXB1, and PXB2 positioned adjacent to the center branch point PC via branch points PT and PB. For example, the second power voltage transferred through the third power supply voltage line ELVDD1 can be applied to the pixel PXT1 and the pixel PXT2 via the branch point PT of the fourth power supply voltage line ELVDD2. The second power voltage transferred through the third power supply voltage line ELVDD1 can be applied to the pixel PX11 and the pixel PX12 via the branch point P1 of the fourth power supply voltage line ELVDD2. That is, the second power voltage can be sequentially transferred from the pixel PXT1 and the pixel PXT2 to the pixel PX11 and the pixel PX12. In addition, the second power voltage transferred through the third power supply voltage line ELVDD1 can be applied to the pixel PXB1 and the pixel PXB2 via the branch point PB of the fourth power supply voltage line ELVDD2. The second power voltage transferred through the third power supply voltage line ELVDD1 can be applied to the pixel PXn1 and the pixel PXn2 via the branch point Pn of the fourth power supply voltage line ELVDD2. That is, the second power voltage can be sequentially transferred from the pixel PXB1 and the pixel PXB2 to the pixel PXn1 and the pixel PXn2. In this manner, the second power voltage can transferred to the pixels PX11 through PXnm from the center portion CENTER to the first end portion BOTTOM and the second end portion TOP via the branch points P1 through Pn of the fourth power supply voltage line ELVDD2.

While one branch point as illustrated in FIG. 10 is electrically connected to two pixels, the branch point can be electrically connected to one pixel or at least two pixels.

Figure 11:
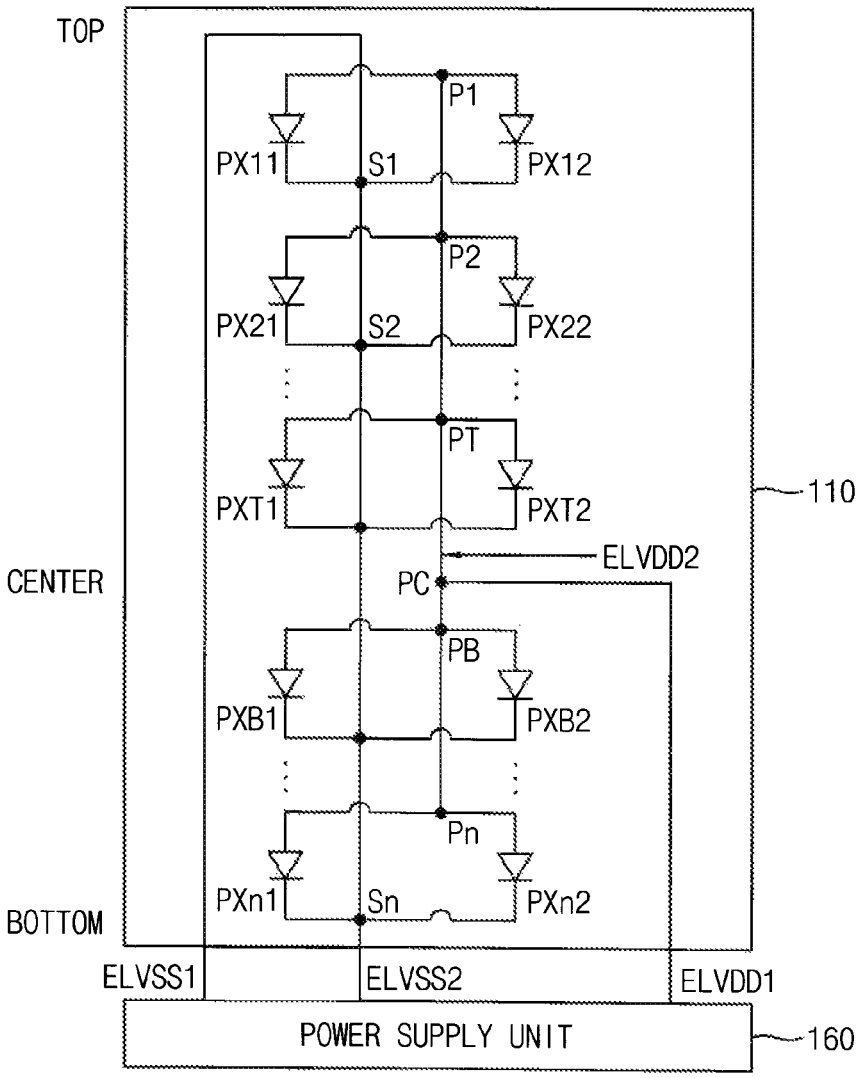
FIG. 11 is a diagram illustrating an organic light-emitting diode display in accordance with example embodiments.
Figure 12:
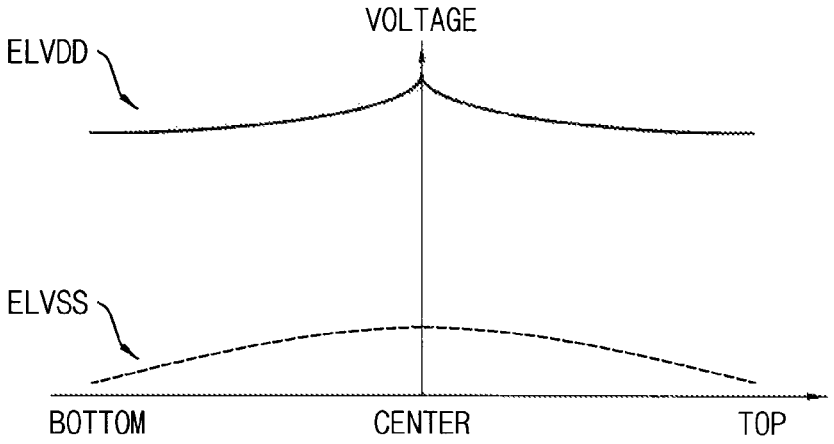
FIG. 12 is a graph illustrating an example of high power supply voltage and a low power supply voltage in an organic light-emitting diode display of FIG. 11.
Figure 13:
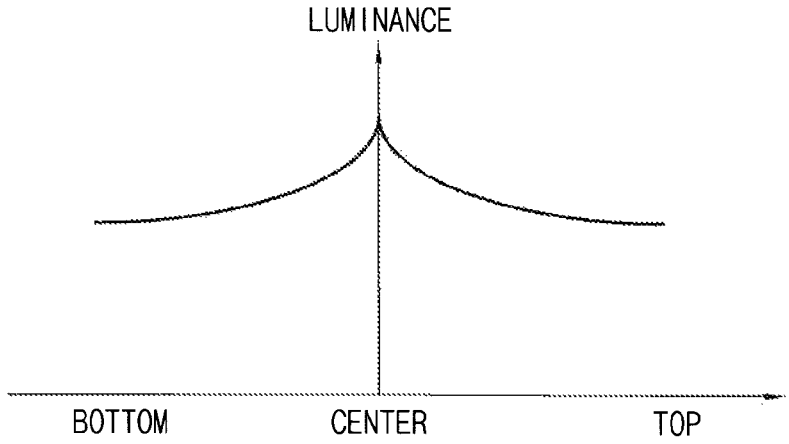
FIG. 13 is a graph illustrating an example of luminance of a display panel included in an organic light-emitting diode display of FIG. 11.

FIG. 11 is a diagram illustrating an OLED display in accordance with example embodiments. FIG. 12 is a graph illustrating an example of high power supply voltage and a low power supply voltage in the OLED display of FIG. 11. FIG. 13 is a graph illustrating an example of luminance of a display panel included in the OLED display of FIG. 11.

Referring to FIG. 11, a portion of an OLED display 100 including first and second power supply voltage lines ELVSS1 and ELVSS2 transferring a first power voltage of the power supply unit 160 and third and fourth power supply voltage lines ELVDD1 and ELVDD2 transferring a second power voltage is illustrated. The OLED display 100 includes a display panel 110, a plurality of pixels PX11 through PXnm positioned in the display panel 110, the power supply unit 160, the first power supply voltage line ELVSS1, the second power supply voltage line ELVSS2, the third power supply voltage line ELVDD1, and the fourth power supply voltage line ELVDD2. Since the OLED display 100 has been described in detail with reference to the FIGS. 6 through 10, repeated description of the OLED display 100 will be omitted.

Referring to FIG. 12, the vertical axis of FIG. 12 represents a magnitude of a voltage level, and the horizontal axis represents a first end portion BOTTOM, a center portion CENTER, and a second end portion TOP of the display panel 110 illustrated in FIG. 11. When the power supply unit 160 is driven by a method illustrated in FIG. 11, a low power supply voltage ELVSS (i.e., first power voltage) of the power supply unit 160 can be transferred from the first and second end portions BOTTOM and TOP to the center portion CENTER. In addition, a high power supply voltage ELVDD (i.e., second power voltage) of the power supply unit 160 can be transferred from the center portion CENTER to the first and second end portions BOTTOM and TOP. In this case, the low power supply voltage ELVSS can be substantially simultaneously provided to the first and second end portions BOT- TOM and TOP. Here, a voltage level of the low power supply voltage ELVSS transferred through the first power supply voltage line ELVSS1 can be increased by an IR drop because the low power supply voltage ELVSS is passed from the second end portion TOP to the center portion CENTER. Similarly, a voltage level of the low power supply voltage ELVSS transferred through the second power supply voltage line ELVSS2 can be increased by an IR drop because the low power supply voltage ELVSS is passed from the first end portion BOTTOM to the center portion CENTER. Meanwhile, the high power supply voltage ELVDD can be substantially simultaneously provided from the center portion CENTER (i.e., the center branch point PC) to the first and second end portions BOTTOM and TOP. Here, a voltage level of the high power supply voltage ELVDD transferred through the third power supply voltage line ELVDD1 can be decreased by an IR drop because the high power supply voltage ELVDD is passed from the center portion CENTER to the first and second end portions BOTTOM and TOP. As illustrated in FIG. 12, a voltage level of the high power supply voltage ELVDD has a high voltage level in the center portion CENTER, and a voltage level of the high power supply voltage ELVDD can have a low voltage level in the first and second end portions BOTTOM and TOP. In addition, a voltage level of the low power supply voltage ELVSS can have a high voltage level in the center portion CENTER, and can have a low voltage level in the first and second end portions BOTTOM and TOP.

Referring to FIG. 13, when the OLED display 100 is driven by a digital driving method, a difference of the high power supply voltage ELVDD and the low power supply voltage ELVSS is defined as luminance. The luminance of the center portion CENTER can be higher than the luminance of the first and second end portions BOTTOM and TOP. Here, a slope of the center portion CENTER can be arranged by a timing control unit. For example, the timing control unit decreases a luminance difference between the first and second end portions BOTTOM and TOP and the center portion CENTER. Also, a shape of a luminance graph in the center portion CENTER can convert a sharp shape to a round shape. In this case, a problem where an afterimage of an image sticking pattern is remained in the first and second end portions BOTTOM and TOP of the typical display panel can be improved. Compared to the center portion CENTER of the typical display panel, as a high voltage level can be applied to the first and second end portions BOTTOM and TOP of the typical display panel, a problem where a deterioration of components of a typical OLED display quickly occur in the first and second end portions BOTTOM and TOP of the typical display panel can be improved. In addition, when a user of the OLED display 100 watches a movie using a wide screen display, the first and second end portions BOTTOM and TOP which are low luminance regions can be black. The center portion CENTER which is a high luminance region can display an image. Thus, in this case, the OLED display 100 can be efficiently operated. Furthermore, in some embodiments as the OLED display 100 is driven using the first power supply voltage line ELVSS1 by the dual bank method, the OLED display 100 does not include many components such as additional power supply unit 160, additional data driving unit 130, etc. A manufacturing cost of the OLED display 100 can be decreased. Also, when the many components are not added to the OLED display 100, a dead space of the OLED display 100 can be decreased.

Figure 14:
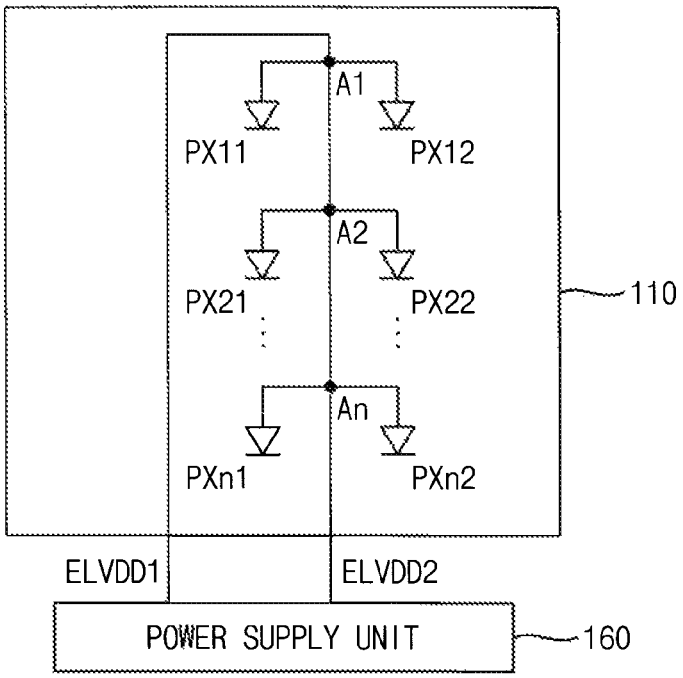
FIG. 14 is a diagram illustrating an example of a high power supply voltage line included in an organic light-emitting diode display in accordance with example embodiments.

FIG. 14 is a diagram illustrating an example of a high power supply voltage line included in an OLED display in accordance with example embodiments.

Referring to FIG. 14, the display panel 110 can include the first end portion BOTTOM, the center portion CENTER, and the second end portion TOP. The power supply unit 160 can include a first power supply voltage line ELVDD1, a second power supply voltage line ELVDD2, a third power supply voltage line ELVSS1 (shown in FIG. 15), and a fourth power supply voltage line ELVSS2 (shown in FIG. 15). Here, the first power supply voltage line ELVDD1 can include a first end positioned in the first end portion BOTTOM of and a second end positioned in the second end portion TOP. The second power supply voltage line ELVDD2 can include a first end positioned in the first end portion BOTTOM and a second end positioned in the second end portion TOP. Here, the second end of the second power supply voltage line ELVDD2 can be electrically connected to the second end of the first power supply voltage line ELVDD1 in the second end portion TOP. In addition, the second power supply voltage line ELVDD2 can be electrically connected to pixels PX. The third power supply voltage line ELVSS1 can include a first end positioned in the first end portion BOTTOM and a second end positioned in the center portion CENTER. The fourth power supply voltage line ELVSS2 can include a first end positioned in the first end portion BOTTOM and a second end positioned in the second end portion TOP. Here, the fourth power supply voltage line ELVSS2 can be electrically connected to the second end of the third power supply voltage line ELVSS1 in the center portion CENTER, and the fourth power supply voltage line ELVSS2 can be electrically connected to the pixels PX. The power supply unit 160 can generate a first power voltage and a second power voltage. The power supply unit 160 can be positioned adjacent to the first end portion BOTTOM. The power supply unit 160 can provide the first power voltage to the first end of the first power supply voltage line ELVDD1 and the first end of the second power supply voltage line ELVDD2, and can provide the second power voltage to the first end of the third power supply voltage line ELVSS1. In example embodiments, the first power voltage can be a high power supply voltage ELVDD, and the second power voltage can be a low power supply voltage ELVSS.

The first power voltage can be provided from the first and second end portions BOTTOM and TOP to the center portion CENTER via the first power supply voltage line ELVDD1 and the second power supply voltage line ELVDD2. For example, the first power voltage applied to the first end of the first power supply voltage line ELVDD1 can be provided to the pixels PX in a direction from the second end portion TOP to the first end portion BOTTOM via the first power supply voltage line ELVDD1, the second end of the first power supply voltage line ELVDD1, the second end of the second power supply voltage line ELVDD2, and the second power supply voltage line ELVDD2. Here, the direction can be defined as a first direction. In addition, the first power voltage applied to the first end of the second power supply voltage line ELVDD2 can be provided to the pixels PX in a direction from the first end portion BOTTOM to the second end portion TOP via the second power supply voltage line ELVDD2. Here, the direction can be defined as a second direction. Accordingly, the first power voltage can be provided to the pixels PX. A voltage level of the first power voltage applied in the first end portion BOTTOM of the first power supply voltage line ELVDD1 and the second power supply voltage line ELVDD2 can be substantially the same. In example embodiments, the first power supply voltage line ELVDD1 can include the first end positioned in the first end portion BOTTOM and the second end positioned in the second end portion TOP. Here, the first end of the first power supply voltage line ELVDD1 can be electrically connected to the power supply unit 160, and the second end of the first power supply voltage line ELVDD1 can be electrically connected to the second end of the second power supply voltage line ELVDD2. The second power supply voltage line ELVDD2 can include the first end positioned in the first end portion BOTTOM and the second end positioned in the second end portion TOP. Here, the first end of the second power supply voltage line ELVDD2 can be electrically connected to the power supply unit 160, and the second end of the second power supply voltage line ELVDD2 can be electrically connected to the second end of the first power supply voltage line ELVDD1. The first power voltage provided to the first end of the first power supply voltage line ELVDD1 can be passed from the first end portion BOTTOM to the second end portion TOP via the first power supply voltage line ELVSS1. In some embodiments, when the first power voltage is passed from the first end portion BOTTOM to the second end portion TOP via the first power supply voltage line ELVDD1, the first power supply voltage line ELVDD1 is not electrically connected to the pixels PX. At substantially the same time, the first power voltage provided to the second power supply voltage line ELVDD2 can be passed from the first end portion BOTTOM to the second end portion TOP. Here, as the first power voltage is passed in the second direction via the first power supply voltage line ELVDD1, an IR drop of the first power voltage can occur. Thus, to substantially equally provide a voltage level of the first power voltage applied to the pixels PX positioned adjacent to the first end portion BOTTOM and a voltage level of the first power voltage to the pixels PX positioned adjacent to the second end portion TOP, the second power supply voltage line ELVDD2 can further include the resistance structure. That is, the resistance structure can be positioned between the power supply unit 160 and the second power supply voltage line ELVDD2 such that a voltage level of the first power supply voltage provided to the first end of the second power supply voltage line ELVDD2 via the resistance structure is substantially the same as a voltage level of the first power supply voltage provided to the second end of the second power supply voltage line ELVDD2 via the first power supply voltage line ELVDD1 (Refer to FIGS. 7 through 9).

The display panel 110 can include pixels PX11 through PXnm. For example, the pixel PX11 is electrically connected to a first scan line SL1 and a first data line DL1 and the pixel PX12 is electrically connected to the first scan line SL1 and a second data line DL2. Similarly, the pixel PXn1 can be electrically connected to an nth scan line SLn and the first data line DL1, and the pixel PXn2 can be electrically connected to the nth scan line SLn and the second data line DL2. The second power supply voltage line ELVDD2 can include a plurality of branch points. For example, the second power supply voltage line ELVDD2 can include a first branch point A1 through an nth branch point An. Here, the first branch point A1 can be electrically connected to the pixel PX11 and the pixel PX12, and the second branch point A2 can be electrically connected to the pixel PX21 and the pixel PX22. Similarly, the nth branch point An can be electrically connected to the pixel PXn1 and the pixel PXn2. For example, each of the pixels PX includes an anode electrode, a cathode electrode opposite to the anode, an emission layer between the anode electrode and the cathode electrode. Each of the branch points A1 through An can be electrically connected to each of the anode electrode of the pixels PX11 through PXnm.

The first power voltage transferred through the first power supply voltage line ELVDD1 can be applied to the pixel PX11 and the pixel PX12 via the first branch point A1 of the second power supply voltage line ELVDD2. That is, the first power voltage can be sequentially transferred from the pixel PX11 and the pixel PX12 to the pixels PX positioned in the center portion CENTER. In addition, the first power voltage transferred through the second power supply voltage line ELVDD2 can be applied to the pixel PXn1 and the pixel PXn2 via the nth branch point An of the second power supply voltage line ELVDD2. That is, the first power voltage can be sequentially transferred from the pixel PXn1 and the pixel PXn2 to the pixels PX positioned in the center portion CENTER. In this manner, the first power voltage can transferred to the pixels PX11 through PXnm from the first and second end portions BOTTOM and TOP to the center portion CENTER via the branch points A1 through An of the second power supply voltage line ELVDD2.

While one branch point as illustrated in FIG. 14 is electrically connected to two pixels, the branch point can be electrically connected to one pixel or at least two pixels.

Figure 15:
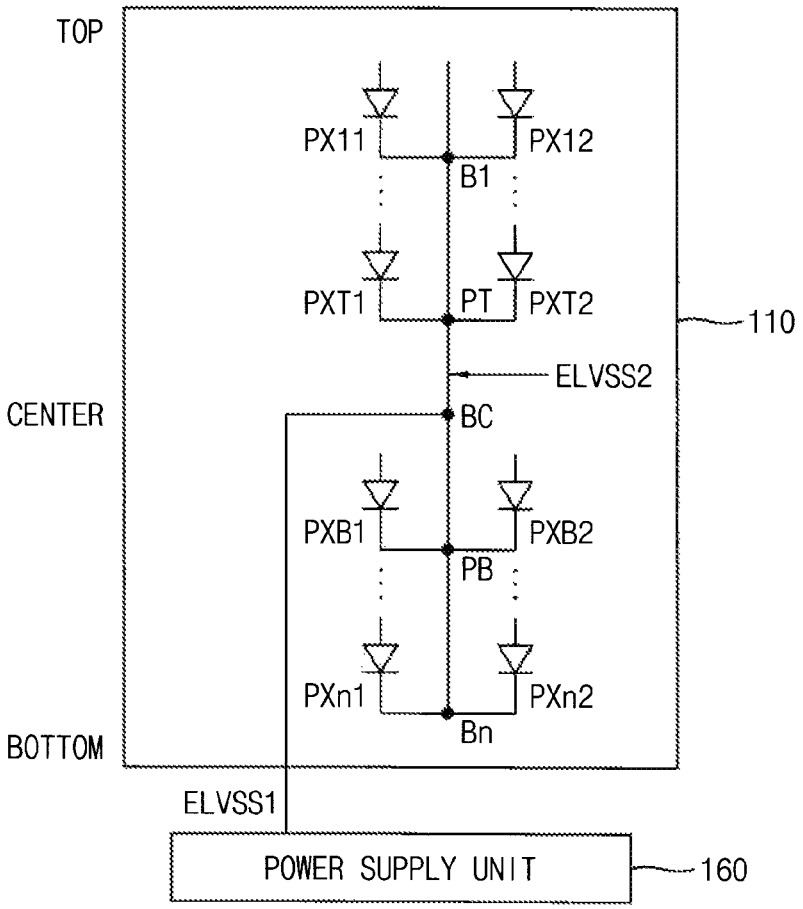
FIG. 15 is a diagram illustrating an example of a low power supply voltage line included in an organic light-emitting diode display in accordance with example embodiments.

FIG. 15 is a diagram illustrating an example of a low power supply voltage line included in an OLED display in accordance with example embodiments.

Referring to FIG. 15, the display panel 110 can include the first end portion BOTTOM, the center portion CENTER, and the second end portion TOP. The power supply unit 160 can include the first power supply voltage line ELVDD1 (shown FIG. 14), the second power supply voltage line ELVDD2 (shown FIG. 14), the third power supply voltage line ELVSS1, and the fourth power supply voltage line ELVSS2. Here, the first power supply voltage line ELVDD1 can include a first end positioned in the first end portion BOTTOM and a second end positioned in the second end portion TOP. The second power supply voltage line ELVDD2 can include a first end positioned in the first end portion BOTTOM and a second end positioned in the second end portion TOP. Here, the second end of the second power supply voltage line ELVDD2 can be electrically connected to the second end of the first power supply voltage line ELVDD1 in the second end portion TOP. In addition, the second power supply voltage line ELVDD2 can be electrically connected to pixels PX. The third power supply voltage line ELVSS1 can include a first end positioned in the first end portion BOTTOM and a second end positioned in the center portion CENTER. The fourth power supply voltage line ELVSS2 can include a first end positioned in the first end portion BOTTOM and a second end positioned in the second end portion TOP. Here, the fourth power supply voltage line ELVSS2 can be electrically connected to the second end of the third power supply voltage line ELVSS1 in the center portion CENTER, and the fourth power supply voltage line ELVSS2 can be electrically connected to the pixels PX. The power supply unit 160 can generate a first power voltage and second power voltage. The power supply unit 160 can be positioned adjacent to the first end portion BOTTOM. The power supply unit 160 can provide the first power voltage to the first end of the first power supply voltage line ELVDD1 and the first end of the second power supply voltage line ELVDD2, and can provide the second power voltage to the first end of the third power supply voltage line ELVSS1. In example embodiments, the first power voltage can be a high power supply voltage ELVDD, and the second power voltage can be a low power supply voltage ELVSS.

The second power voltage can be transferred to a center branch point BC via the third power supply voltage line ELVSS1. The second power voltage can be provided from the center portion CENTER to the first and second end portions BOTTOM and TOP. For example, the second power voltage applied to the first end of the third power supply voltage line ELVSS1 is provided to the pixels PX in directions from the center portion CENTER to the first end portion BOTTOM and the second end portion TOP via the third power supply voltage line ELVSS1, the second end of the third power supply voltage line ELVSS1, and the fourth power supply voltage line ELVSS2. Here, the direction from the center portion CENTER to the first end portion BOTTOM can be defined as a third direction, and the direction from the center portion CENTER to the second end portion TOP can be defined as a fourth direction. Accordingly, the second power voltage can be provided to the pixels PX.

In example embodiments, the third power supply voltage line ELVSS1 includes the first end positioned in the first end portion BOTTOM and the second end positioned in the center portion CENTER. Here, the first end of the third power supply voltage line ELVSS1 can be electrically connected to the power supply unit 160, and the second end of the third power supply voltage line ELVSS1 can be electrically connected to the fourth power supply voltage line ELVSS2 in the center portion CENTER. The fourth power supply voltage line ELVSS2 can include the first end positioned in the first end portion BOTTOM and the second end positioned in the second end portion TOP. Here, the fourth power supply voltage line ELVSS2 can be electrically connected to the second end of the third power supply voltage line ELVSS1 in the center portion CENTER. The display panel 110 can include pixels PX11 through PXnm. For example, the pixel PX11 is electrically connected to a first scan line SL1 and a first data line DL1 and the pixel PX12 is electrically connected to the first scan line SL1 and a second data line DL2. Similarly, the pixel PXn1 can be electrically connected to an nth scan line SLn and the first data line DL1, and the pixel PXn2 can be electrically connected to the nth scan line SLn and the second data line DL2. The fourth power supply voltage line ELVSS2 can include a plurality of branch points. For example, the fourth power supply voltage line ELVSS2 includes a first branch point B1 through an nth branch point Bn. Here, the first branch point B1 can be electrically connected to the pixel PX11 and the pixel PX12, and the second branch point B2 can be electrically connected to the pixel PX21 and the pixel PX22. Similarly, the nth branch point Bn can be electrically connected to the pixel PXn1 and the pixel PXn2. In particular, each of the pixels PX can include an anode electrode, a cathode electrode opposite to the anode, an emission layer between the anode electrode and the cathode electrode. Each of the branch points B1 through Bn can be electrically connected to each of the cathode electrode of the pixels PX11 through PXnm. The fourth power supply voltage line ELVSS2 can further include a center branch point BC. The center branch point BC can be positioned in the center of the first branch point B1 through the nth branch point Bn. The third power supply voltage line ELVSS1 can be electrically connected to the fourth power supply voltage line ELVSS2 (e.g., the second end of the fourth power supply voltage line ELVSS2) via the center branch point BC. After the second power voltage transferred through the third power supply voltage line ELVSS1 is divided by the center branch point BC, the second power voltage can be provided to the pixels PXT1, PXT2, PXB1, and PXB2 positioned adjacent to the center branch point BC via branch points PT and PB. For example, the second power voltage transferred through the third power supply voltage line ELVSS1 is applied to the pixel PXT1 and the pixel PXT2 via the branch point PT of the fourth power supply voltage line ELVSS2. The second power voltage transferred through the third power supply voltage line ELVSS1 can be applied to the pixel PX11 and the pixel PX12 via the branch point B1 of the fourth power supply voltage line ELVSS2. That is, the second power voltage can be sequentially transferred from the pixel PXT1 and the pixel PXT2 to the pixel PX11 and the pixel PX12. In addition, the second power voltage transferred through the third power supply voltage line ELVSS1 can be applied to the pixel PXB1 and the pixel PXB2 via the branch point PB of the fourth power supply voltage line ELVSS2. The second power voltage transferred through the third power supply voltage line ELVSS1 can be applied to the pixel PXn1 and the pixel PXn2 via the branch point Bn of the fourth power supply voltage line ELVSS2. That is, the second power voltage can be sequentially transferred from the pixel PXB1 and the pixel PXB2 to the pixel PXn1 and the pixel PXn2. In this manner, the second power voltage can transferred to the pixels PX11 through PXnm from the center portion CENTER to the first and second end portions BOTTOM and TOP via the branch points B1 through Bn of the fourth power supply voltage line ELVSS2.

While one branch point as illustrated in FIG. 15 is electrically connected to two pixels, the branch point can be electrically connected to one pixel or at least two pixels.

Figure 16:
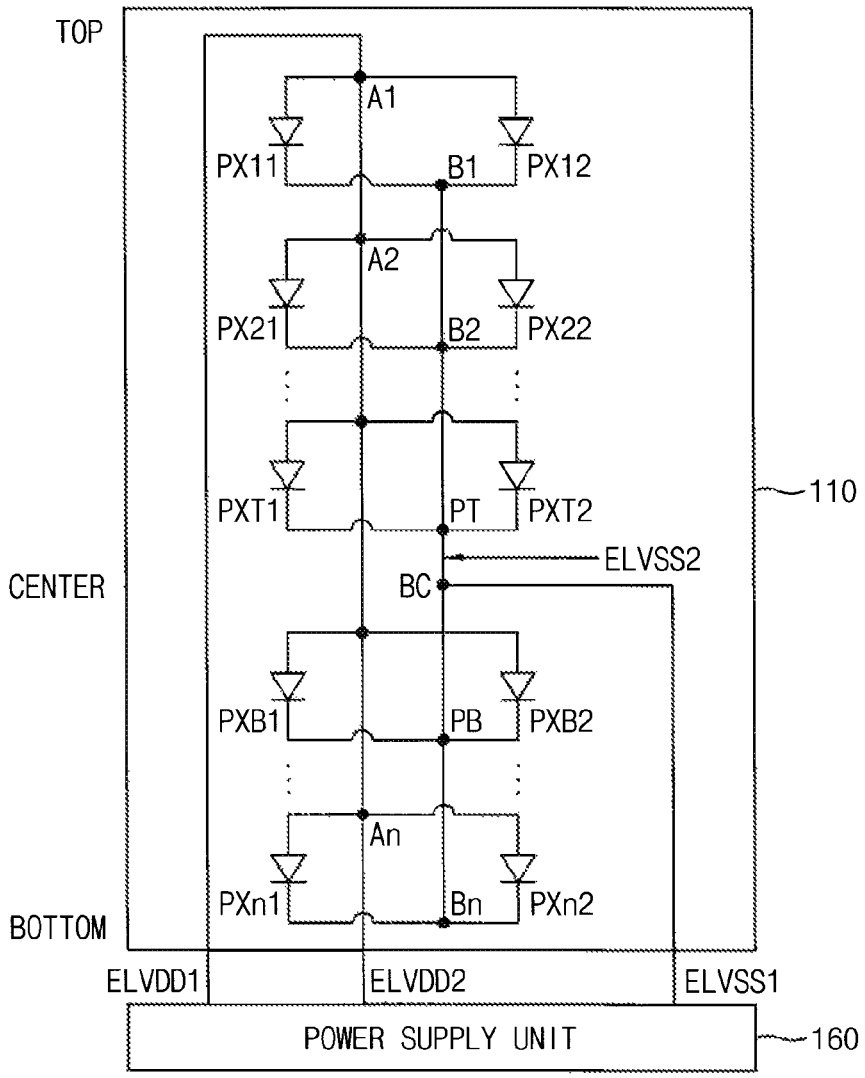
FIG. 16 is a diagram illustrating an organic light-emitting diode display in accordance with example embodiments.
Figure 17:
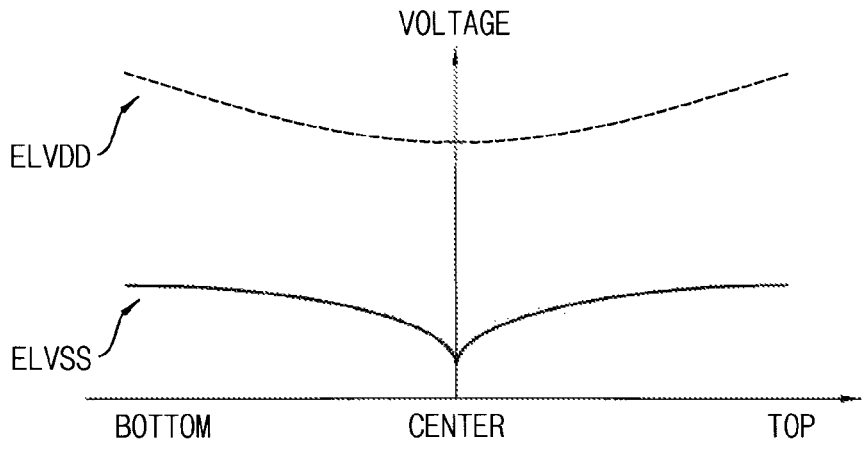
FIG. 17 is a graph illustrating an example of a high power supply voltage and a low power supply voltage in an organic light-emitting diode display of FIG. 16.
Figure 18:
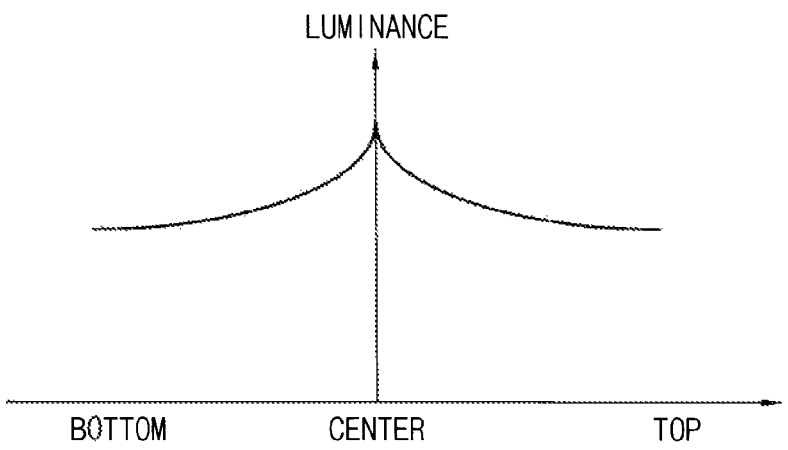
FIG. 18 is a graph illustrating an example of luminance of a display panel included in an organic light-emitting diode display of FIG. 16.

FIG. 16 is a diagram illustrating an OLED display in accordance with example embodiments. FIG. 17 is a graph illustrating an example of a high power supply voltage and a low power supply voltage in an OLED display of FIG. 16. FIG. 18 is a graph illustrating an example of luminance of a display panel included in an OLED display of FIG. 16.

Referring to FIG. 16, a portion of an OLED display including first and second power supply voltage lines ELVDD1 and ELVDD2 transferring a first power voltage of a power supply unit 160 and third and fourth power supply voltage lines ELVSS1 and ELVSS2 transferring a second power voltage is illustrated. The OLED display includes the display panel 110, a plurality of pixels PX11 through PXnm positioned in the display panel 110, the power supply unit 160, the first power supply voltage line ELVDD1, the second power supply voltage line ELVDD2, the third power supply voltage line ELVSS1, and the fourth power supply voltage line ELVSS2. Since the OLED display has been described in detail with reference to FIGS. 14 and 15, repeated description of the OLED display will be omitted.

Referring to FIG. 17, the vertical axis of FIG. 17 represents a magnitude of a voltage level, and the horizontal axis represents a first end portion BOTTOM, a center portion CENTER, and a second end portion TOP of the display panel 110 illustrated in FIG. 16. When the power supply unit 160 of the OLED display is driven by a method illustrated in FIG. 16, a high power supply voltage ELVDD (i.e., first power voltage) of the power supply unit 160 can be transferred from the first and second end portions BOTTOM and TOP to the center portion CENTER. In addition, a low power supply voltage ELVSS (i.e., second power voltage) of the power supply unit 160 can be transferred from the center portion CENTER to the first and second end portions BOTTOM and TOP. In this case, the high power supply voltage ELVDD can be substantially simultaneously provided to the first and second end portions BOTTOM and TOP. Here, a voltage level of the high power supply voltage ELVDD transferred through the first power supply voltage line ELVDD1 can be decreased by an IR drop because the high power supply voltage ELVDD is passed from the second end portion TOP to the center portion CENTER. Similarly, a voltage level of the high power supply voltage ELVDD transferred through the second power supply voltage line ELVDD2 can be decreased by an IR drop because the high power supply voltage ELVDD is passed from the first end portion BOTTOM to the center portion CENTER. Meanwhile, the low power supply voltage ELVSS can be substantially simultaneously provided from the center portion CENTER (i.e., the center branch point BC) to the first and second end portions BOTTOM and TOP. Here, a voltage level of the low power supply voltage ELVSS transferred through the third power supply voltage line ELVSS1 can be increased by an IR drop because the low power supply voltage ELVSS is passed from the center portion CENTER to the first and second end portions BOTTOM and TOP. As illustrated in FIG. 17, a voltage level of the low power supply voltage ELVSS can have a low voltage level in the center portion CENTER, and can have a high voltage level in the first and second end portions BOTTOM and TOP. In addition, a voltage level of the high power supply voltage ELVDD can have a low voltage in the center portion CENTER, and can have a high voltage level in the first and second end portions BOTTOM and TOP.

Referring to FIG. 18, when the OLED display is driven by a digital driving method, a difference of the high power supply voltage ELVDD and the low power supply voltage ELVSS can be defined as luminance. The luminance of the center portion CENTER can be higher than the luminance of the first and second end portions BOTTOM and TOP. Here, a slope of the center portion CENTER can be arranged by a timing control unit. For example, the timing control unit decreases a luminance difference between the first and second end portions BOTTOM and TOP and the center portion CENTER. Also, a shape of a luminance graph in the center portion CENTER can convert a sharp shape to a substantially round shape. In this case, a problem where an afterimage of an image sticking pattern is remained in the first and second end portions BOTTOM and TOP of the typical display panel can be improved. Compared to the center portion CENTER of the typical display panel, as a high voltage level can be applied to the first and second end portions BOTTOM and TOP of the typical display panel, it can improve a problem where a deterioration of components of a typical OLED display quickly occurs in the first and second end portions BOTTOM and TOP of the typical display panel. In addition, when a user of the OLED display watches a movie using a wide screen display, the first and second end portions BOTTOM and TOP which are low luminance regions can be black. The center portion CENTER which is a high luminance region can display an image. Thus, in this case, the OLED display can be efficiently operated. Furthermore, as the OLED display is driven using the first power supply voltage line ELVDD1 by the dual bank method, the OLED display can not include many components such as additional power supply unit 160, additional data driving unit 130, etc. A manufacturing cost of the OLED display can be decreased. Also, when the many components are not added to the OLED display device, a dead space of the OLED display 100 can be decreased.

Figure 19:
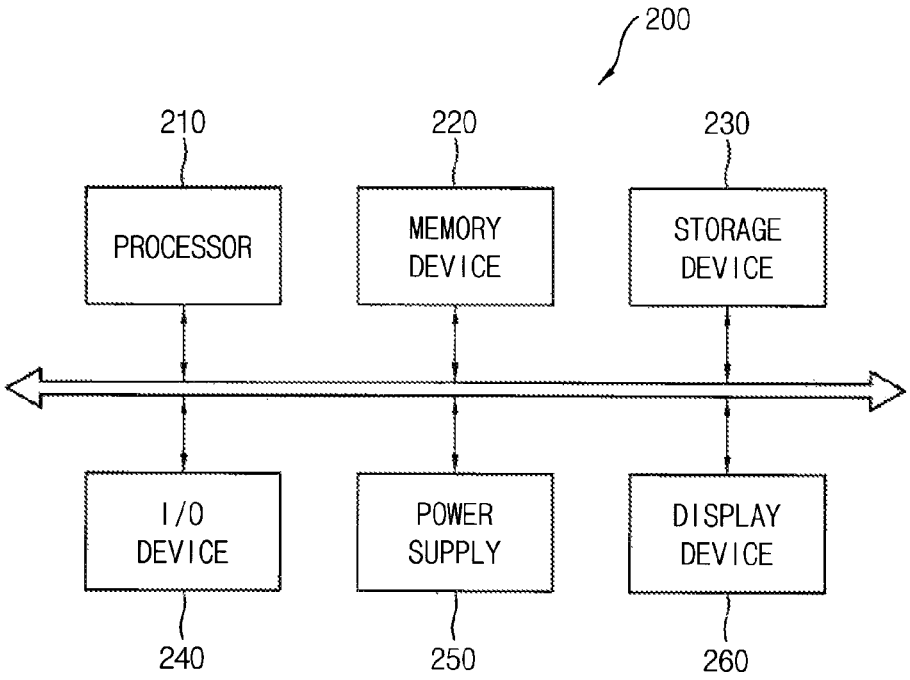
FIG. 19 is a block diagram illustrating an electronic having a display in accordance with example embodiments.
Figure 20:
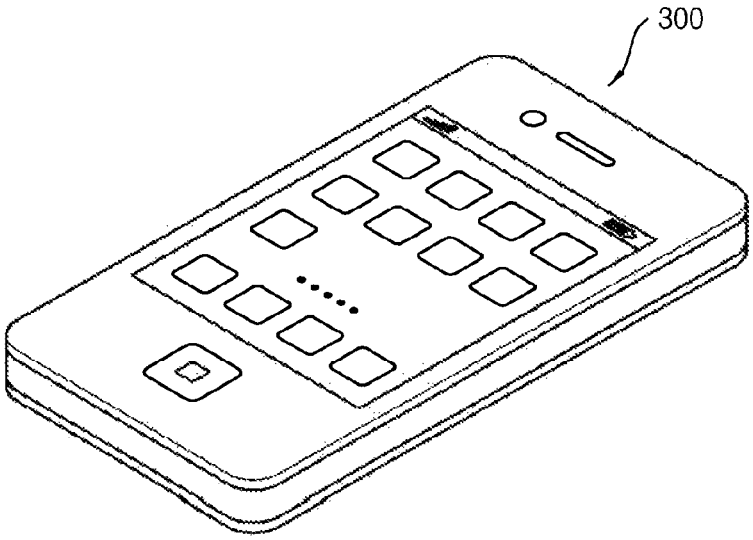
FIG. 20 is a diagram illustrating an example in which the electronic of FIG. 19 is implemented as a smartphone.

FIG. 19 is a block diagram illustrating an electronic having a display in accordance with example embodiments. FIG. 20 is a diagram illustrating an example in which the electronic of FIG. 19 is implemented as a smartphone.

Referring to FIGS. 19 and 20, an electronic 200 includes a processor 210, a memory 220, a storage 230, an input/output (I/O) 240, a power supply 250, and an OLED display 260. Here, the electronic 200 can further include a plurality of ports for communicating a video card, a sound card, a memory card, a universal serial bus (USB) device, other electronic devices, etc. Although it is illustrated in FIG. 12 that the electronic 200 is implemented as a smartphone 300, the kind of the electronic 200 is not limited thereto.

The processor 210 can perform various computing functions. The processor 210 can be a microprocessor, a central processing unit (CPU), etc. The processor 210 can be electrically connected to other components via an address bus, a control bus, a data bus, etc. Further, the processor 210 can be electrically connected to an extended bus such as a peripheral component interconnection (PCI) bus.

The memory 220 can store data for operations of the electronic 200. For example, the memory 220 is at least one non-volatile memory such as an erasable programmable read-only memory (EPROM) device, an electrically erasable programmable read-only memory (EEPROM) device, a flash memory device, a phase change random access memory (PRAM) device, a resistance random access memory (RRAM) device, a nano-floating gate memory (NFGM) device, a polymer random access memory (PoRAM) device, a magnetic random access memory (MRAM) device, a ferroelectric random access memory (FRAM) device, etc, and/or at least one volatile memory such as a dynamic random access memory (DRAM) device, a static random access memory (SRAM) device, a mobile DRAM device, etc.

The storage 230 can be a solid state drive (SSD) device, a hard disk drive (HDD) device, a CD-ROM device, etc. The I/O 240 can be an input such as a keyboard, a keypad, a touchpad, a touch-screen, a mouse, etc., and an output such as a printer, a speaker, etc. The power supply 250 can provide power for operations of the electronic 200. The OLED display 260 can communicate with other components via the buses or other communication links.

The OLED display 260 can correspond to the OLED display 100 of FIG. 1 that includes the pixel circuit of FIG. 2 and the power supply unit 160 having first through fourth power supply voltage lines ELVSS1, ELVSS2, ELVDD1, and ELVDD2 of FIG. 11. Therefore, since the OLED display 260 includes the first through fourth power supply voltage lines ELVSS1, ELVSS2, ELVDD1, and ELVDD2, the luminance of pixels PX positioned in a center portion CENTER of OLED display 260 is higher than that of pixels PX positioned in a first and second end portions BOTTOM and TOP of OLED display 260.

The example embodiments can be applied to any electronic system 200 having the OLED display 260. For example, the present embodiments are applied to the electronic system 200, such as a digital or 3D television, a computer monitor, a home appliance, a laptop computer, a digital camera, a cellular phone, a smartphone, a personal digital assistant (PDA), a portable multimedia player (PMP), a MP3 player, a portable game console, a navigation system, a video phone, etc.

The described technology can be applied to a display device having a power supply unit. For example, the described technology can be applied to the mobile phone, the smartphone, the laptop computer, the tablet computer, the personal digital assistant (PDA), the portable multimedia player (PMP), the digital camera, the music player (e.g., a MP3 player), the portable game console, the navigation, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. An organic light-emitting diode (OLED) display comprising:

a display panel comprising a plurality of pixels and having first and second end portions opposing each other, and a center portion therebetween;

a first power supply voltage line extending from the first end portion to the second end portion, wherein the first power supply voltage line has first and second ends respectively formed in the first and second portions;

a second power supply voltage line extending from the first end portion to the second end portion, wherein the second power supply voltage line has first and second ends respectively formed in the first and second portions, wherein the second end of the second power supply voltage line is electrically connected to the second end of the first power supply voltage line, and wherein the second power supply voltage line is electrically connected to the pixels;

a third power supply voltage line having first and second ends respectively formed in the first and center portions;

a fourth power supply voltage line having first and second ends respectively formed in the first and second end portions, wherein the fourth power supply voltage line is electrically connected to the second end of the third power supply voltage line in the center portion, and wherein the fourth power supply voltage line is electrically connected to the pixels; and a power supply unit formed adjacent to the first end portion and configured to apply i) a first power supply voltage to the first ends of the first and second power supply voltage lines and ii) a second power supply voltage to the first end of the third power supply voltage line.

2. The display of claim 1, wherein the power supply unit is further configured to supply the first power supply voltage to the pixels in a first direction extending from the second end portion to the first end portion via the first power supply voltage line, the second end of the first power supply voltage line, the second end of the second power supply voltage line, and the second power supply voltage line, and wherein the power supply unit is further configured to supply the first power supply voltage to the pixels in a second direction extending from the first end portion to the second end portion via the second power supply voltage line.

3. The display of claim 1, wherein the power supply unit is further configured to supply the second power supply voltage to the pixels in a third direction extending from the center portion to the first end portion and in a fourth direction extending from the center portion to the second end portion via the third power supply voltage line, the second end of the third power supply voltage line, and the fourth power supply voltage line.

4. The display of claim 1, wherein each of the pixels includes:

an anode electrode electrically connected to the second power supply voltage line;

a cathode electrode opposite to the anode electrode and electrically connected to the fourth power supply voltage line; and an emission layer formed between the anode and cathode electrodes.

5. The display of claim 1, wherein each of the pixels includes:

an anode electrode electrically connected to the fourth power supply voltage line;

a cathode electrode opposite to the anode electrode and electrically connected to the second power supply voltage line; and an emission layer formed between the anode and cathode electrodes.

6. The display of claim 1, further comprising:

a resistance structure formed adjacent to the power supply unit such that a voltage level of the first power supply voltage provided to the second power supply voltage line via the resistance structure is substantially the same as a voltage level of the first power supply voltage provided to the second power supply voltage line via the first power supply voltage line.

7. The display of claim 6, wherein the resistance structure includes at least one of the following: an S-shaped electrode pattern, an electrode pattern having a thickness less than that of the first power supply voltage line, an electrode pattern having a width less than that of the first power supply voltage line, and a bridge electrically connected to the second power supply voltage line via a contact.

8. The display of claim 1, wherein the display is configured to be driven by a digital driving method.

9. The display of claim 1, wherein the first power supply voltage includes a logical high power supply voltage, and wherein the second power supply voltage includes a logical low power supply voltage.

10. The display of claim 1, wherein the first power supply voltage includes a logical low power supply voltage, and wherein the second power supply voltage includes a logical high power supply voltage.

11. The display of claim 1, further comprising:

a scan driver configured to provide a scan signal to the pixels via a plurality of scan lines;

a data driver configured to provide a data signal to the pixels via a plurality of data lines; and a timing controller configured to control the scan driver, the data driver, and the power supply unit.

12. The display of claim 1, wherein the luminance of at least one of the pixels formed in the center portion is higher than the luminance of at least one of the pixels formed in the first or second end portion.

13. An organic light-emitting diode (OLED) display comprising:

a display panel comprising a plurality of pixels and having first and second end portion opposing each other and a center portion therebetween;

a first power supply voltage line extending from the first end portion to the second end portion;

a second power supply voltage line electrically connected to the pixels and extending from the first end portion to the second end portion, wherein the second power supply voltage line is electrically connected to the first power supply voltage line in the second end portion;

a third power supply voltage line extending from the first end portion to the center portion;

a fourth power supply voltage line electrically connected to the pixels and extending from the first end portion to the second end portion, wherein the fourth power supply voltage line is electrically connected to the third power supply voltage line in the center portion; and a power supply unit formed adjacent to the first end portion and configured to i) apply a first power supply voltage to the first power supply voltage line so as to provide the first power supply voltage to the pixels in a first direction extending from the second end portion to the first end portion, ii) apply the first power supply voltage to the second power supply voltage line so as to provide the first power supply voltage to the pixels in a second direction extending from the first end portion to the second end portion, and iii) apply a second power supply voltage to the third power supply voltage line so as to provide the second power supply voltage to the pixels in a third direction extending from the center portion to the first end portion and in a fourth direction extending from the center portion to the second end portion.

14. The display of claim 13, wherein each of the pixels includes:

an anode electrode electrically connected to the second power supply voltage line;

a cathode electrode opposite to the anode electrode and electrically connected to the fourth power supply voltage line; and an emission layer formed between the anode and cathode electrodes.

15. The display of claim 13, wherein each of the pixels includes:

an anode electrode electrically connected to the fourth power supply voltage line;

a cathode electrode opposite to the anode electrode and electrically connected to the second power supply voltage line; and an emission layer formed between the anode and cathode electrodes.

16. The display of claim 13, further comprising:

a resistance structure adjacent to the power supply unit such that a voltage level of the first power supply provided to the second power supply voltage line via the resistance structure is substantially the same as a voltage level of the first power supply voltage provided to the second power supply voltage line via the first power supply voltage line.

17. The display of claim 16, wherein the resistance structure includes at least one of the following: an S-shaped electrode pattern, an electrode pattern having a thickness less than that of the first power supply voltage line, an electrode pattern having a width less than that of the first power supply voltage line, and a bridge electrically connected to the second power supply voltage line via a contact.

18. The display of claim 13, wherein the OLED display is configured to be driven by a digital driving method.

19. The display of claim 13, wherein the first power supply voltage includes a logical high power supply voltage, and wherein the second power supply voltage includes a logical low power supply voltage.

20. The display of claim 13, wherein the first power supply voltage includes a logical low power supply voltage, and wherein the second power supply voltage includes a logical high power supply voltage.

* * * * *